US010182644B2

(12) United States Patent
Jimenez et al.

(10) Patent No.: US 10,182,644 B2
(45) Date of Patent: Jan. 22, 2019

(54) ORAL CARE IMPLEMENT

(71) Applicant: Colgate-Palmolive Company, New York, NY (US)

(72) Inventors: Eduardo Jimenez, Manalapan, NJ (US); Kenneth Waguespack, North Brunswick, NJ (US); Robert Moskovich, East Brunswick, NJ (US); Roger Kirchhofer, Lucerne (CH); Kurt Bieri, Lucerne (CH); Joachim Storz, Zell am See (AT); Andreas Wechsler, Zell am See (AT)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 15/539,357

(22) PCT Filed: Dec. 23, 2014

(86) PCT No.: PCT/US2014/072038
§ 371 (c)(1),
(2) Date: Jun. 23, 2017

(87) PCT Pub. No.: WO2016/105357
PCT Pub. Date: Jun. 30, 2016

(65) Prior Publication Data

US 2017/0347786 A1 Dec. 7, 2017

(51) Int. Cl.
*A46B 9/04* (2006.01)
*A46B 9/02* (2006.01)
(Continued)

(52) U.S. Cl.
CPC ..... *A46B 9/04* (2013.01); *A46B 9/025* (2013.01); *A46B 9/06* (2013.01); *A46D 3/045* (2013.01); *A46B 2200/1066* (2013.01)

(58) Field of Classification Search
CPC ..... A46B 9/04; A46B 9/025; A46B 9/06
(Continued)

(56) References Cited

U.S. PATENT DOCUMENTS 758,764 A 5/1904 MacLeod
846,900 A 3/1907 Bloom
(Continued)

FOREIGN PATENT DOCUMENTS

AR 71556 10/2003
AR 80042 11/2009
(Continued)

OTHER PUBLICATIONS

International Search Report and the Written Opinion issued in International Application PCT/US2010/046806 dated Mar. 16, 2011.
(Continued)

*Primary Examiner* — Michael Jennings

(57) ABSTRACT

An oral care implement that includes a handle (120) and a head (100) with a front surface. A plurality of tooth cleaning elements extend from the front surface. In one embodiment the plurality of tooth cleaning elements include a conical tuft (130) that is formed by a wall of bristles. The tooth cleaning elements may also include first and/or second sets of peripheral tooth cleaning elements located adjacent to opposing lateral edges of the head. The peripheral tooth cleaning elements may include elastomeric sleeve portions (144, 154) and bristle tuft portions (145, 155). The elastomeric sleeve portions may be formed as a part of an integrally formed elastomeric component (170).

19 Claims, 11 Drawing Sheets

(51) Int. Cl.
*A46B 9/06* (2006.01)
*A46D 3/04* (2006.01)

(58) Field of Classification Search
USPC ..... 15/167.1, 191
See application file for complete search history.

(56) References Cited

U.S. PATENT DOCUMENTS 1,125,532 A 1/1915 Himmel
1,770,195 A 7/1930 Burlew
1,901,230 A 3/1933 Palmer
1,924,152 A 8/1933 Coney et al.
2,161,349 A 6/1939 Hadden
2,186,005 A 1/1940 Casto
2,305,461 A * 12/1942 Spyra ..... A46B 9/04 15/167.1
D273,635 S 5/1984 Stocchi
4,517,701 A 5/1985 Stanford, Jr.
4,958,402 A 9/1990 Weihrauch
5,144,712 A 9/1992 Hansel et al.
5,339,482 A 8/1994 Desimone et al.
5,392,483 A 2/1995 Heinzelman et al.
5,584,690 A 12/1996 Maassarani
5,604,951 A 2/1997 Shipp
5,628,082 A 5/1997 Moskovich
5,651,158 A 7/1997 Halm
D390,706 S 2/1998 Hohlbein et al.
5,735,012 A 4/1998 Heinzelman et al.
5,746,532 A 5/1998 Megill et al.
5,758,383 A 6/1998 Hohlbein
5,781,958 A 7/1998 Meessmann et al.
5,799,353 A 9/1998 Yamamoto et al.
5,802,656 A * 9/1998 Dawson ..... A46B 5/0029 15/110
5,839,149 A 11/1998 Scheier et al.
D404,205 S 1/1999 Hohlbein
D404,206 S 1/1999 Hohlbein
5,862,559 A 1/1999 Hunter
5,863,102 A 1/1999 Waguespack et al.
5,908,038 A 6/1999 Bennett
5,915,868 A 6/1999 Frazell
5,930,860 A 8/1999 Shipp
5,946,758 A 9/1999 Hohlbein et al.
5,967,152 A 10/1999 Rimkus
5,970,564 A * 10/1999 Inns ..... A46B 7/06 15/167.1
5,984,935 A 11/1999 Budei et al.
5,991,958 A 11/1999 Hohlbein
6,009,589 A * 1/2000 Driesen ..... A46B 3/16 15/167.1
6,015,293 A 1/2000 Rimkus
6,032,313 A 3/2000 Tsang
6,041,468 A 3/2000 Chen et al.
6,073,299 A 6/2000 Hohlbein
6,088,870 A 7/2000 Hohlbein
D429,887 S 8/2000 Hohlbein et al.
6,099,780 A 8/2000 Gellert
6,131,228 A 10/2000 Chen et al.
6,178,583 B1 1/2001 Volpenhein
6,234,798 B1 5/2001 Salazar et al.
6,276,021 B1 8/2001 Hohlbein
6,292,973 B1 9/2001 Moskovich et al.
D450,457 S 11/2001 Hohlbein
D450,929 S 11/2001 Angelini et al.
6,311,360 B1 * 11/2001 Lanvers ..... A46B 3/16 15/167.1
6,314,606 B1 11/2001 Hohlbein
D451,286 S 12/2001 Hohlbein
D456,138 S 4/2002 Hohlbein
D456,139 S 4/2002 Hohlbein
6,370,726 B1 4/2002 Kini et al.
D457,323 S 5/2002 Hohlbein
6,397,425 B1 6/2002 Szczech et al.
6,408,476 B1 6/2002 Cann
6,421,867 B1 7/2002 Weihrauch
D461,313 S 8/2002 Hohlbein
6,442,786 B2 9/2002 Halm
6,442,787 B2 9/2002 Hohlbein
D464,133 S 10/2002 Barnett et al.
6,463,618 B1 10/2002 Zimmer
D474,608 S 5/2003 Hohlbein
6,564,416 B1 5/2003 Claire et al.
6,596,213 B2 6/2003 Swenson
6,595,087 B2 7/2003 Whalen et al.
6,599,048 B2 7/2003 Kuo
6,601,272 B2 8/2003 Stvartak et al.
6,658,688 B2 12/2003 Gavney, Jr.
D486,649 S 2/2004 Sprosta et al.
6,687,940 B1 2/2004 Gross et al.
6,749,788 B1 6/2004 Holden et al.
6,766,549 B2 7/2004 Klupt
6,792,642 B2 9/2004 Wagstaff
6,820,299 B2 11/2004 Gavney, Jr.
6,820,300 B2 11/2004 Gavney, Jr.
6,859,969 B2 3/2005 Gavney, Jr. et al.
D503,538 S 4/2005 Desalvo
6,886,207 B1 5/2005 Solanki
6,889,405 B2 5/2005 Ritrovato et al.
6,919,038 B2 7/2005 Meyer et al.
6,957,469 B2 10/2005 Davies
D511,249 S 11/2005 Hohlbein
6,972,106 B2 12/2005 Huber et al.
D513,882 S 1/2006 Hohlbein et al.
6,983,507 B2 1/2006 McDougall
D514,320 S 2/2006 Hohlbein
D514,812 S 2/2006 Hohlbein et al.
6,996,870 B2 2/2006 Hohlbein
D516,819 S 3/2006 Hohlbein
D517,812 S 3/2006 Hohlbein et al.
D517,813 S 3/2006 Hohlbein et al.
7,007,332 B2 3/2006 Hohlbein
7,020,928 B2 4/2006 Hohlbein
D520,753 S 5/2006 Hohlbein
7,047,591 B2 5/2006 Hohlbein
7,069,615 B2 7/2006 Gavney, Jr.
7,073,225 B1 7/2006 Ford
D526,487 S 8/2006 Chenvainu et al.
7,083,756 B2 8/2006 Strahler
7,089,621 B2 8/2006 Hohlbein
D527,528 S 9/2006 Hohlbein
D528,803 S 9/2006 Hohlbein
D532,202 S 11/2006 Hohlbein
D532,607 S 11/2006 Hohlbein
7,143,462 B2 12/2006 Hohlbein
7,146,675 B2 12/2006 Ansari et al.
7,168,125 B2 1/2007 Hohlbein
7,181,799 B2 2/2007 Gavney, Jr. et al.
7,182,542 B2 2/2007 Hohlbein
7,213,288 B2 5/2007 Hohlbein
7,219,384 B2 5/2007 Hohlbein
7,273,327 B2 9/2007 Hohlbein et al.
D557,504 S 12/2007 Hohlbein
D557,505 S 12/2007 Hohlbein
7,322,067 B2 1/2008 Hohlbein
D562,560 S 2/2008 Hohlbein
7,331,731 B2 2/2008 Hohlbein et al.
7,354,112 B2 4/2008 Fischer et al.
7,383,619 B2 6/2008 Gross et al.
7,386,909 B2 6/2008 Hohlbein
7,415,788 B2 8/2008 Little
7,458,125 B2 12/2008 Hohlbein
7,472,448 B2 1/2009 Hohlbein et al.
7,478,959 B2 1/2009 Hohlbein
7,480,955 B2 1/2009 Hohlbein et al.
D589,260 S 3/2009 Hohlbein
7,540,844 B2 6/2009 Muser
D598,199 S 8/2009 Russell et al.
D598,654 S 8/2009 Huang
D599,556 S 9/2009 Russell et al.
7,614,111 B2 11/2009 Moskovich et al.
D609,915 S 2/2010 Erskine-Smith et al.
D612,611 S 3/2010 Brown, Jr. et al.
7,712,175 B2 5/2010 Blanchard et al.

(56) References Cited

U.S. PATENT DOCUMENTS

| | | | | |
|---|---|---|---|---|
| 7,721,376 | B2 | 5/2010 | Hohlbein et al. | |
| 7,722,274 | B2 | 5/2010 | Hohlbein et al. | |
| 7,735,174 | B2 | 6/2010 | Hohlbein et al. | |
| D623,415 | S | 9/2010 | Geiberger | |
| 7,788,756 | B2 | 9/2010 | Kraemer | |
| 7,845,042 | B2 | 12/2010 | Moskovich et al. | |
| 7,854,036 | B2 | 12/2010 | Georgi | |
| 7,937,794 | B2 | 5/2011 | Huber et al. | |
| 7,954,191 | B2 | 6/2011 | Hohlbein | |
| 7,958,589 | B2 | 6/2011 | Braun et al. | |
| 7,975,343 | B2 | 7/2011 | Hohlbein et al. | |
| 7,975,346 | B2 | 7/2011 | Moskovch et al. | |
| 7,979,947 | B2 | 7/2011 | Storkel et al. | |
| 8,032,991 | B2 | 10/2011 | Lawless | |
| 8,042,217 | B2 | 10/2011 | Sorrentino | |
| 8,046,864 | B2 | 11/2011 | Baertschi et al. | |
| 8,060,972 | B2 | 11/2011 | Geiberger et al. | |
| 8,069,524 | B2 | 12/2011 | Kraemer | |
| 8,083,980 | B2 | 12/2011 | Huber et al. | |
| 8,239,996 | B2 | 8/2012 | Garber et al. | |
| 8,307,488 | B2 | 11/2012 | Pfenniger et al. | |
| 8,327,492 | B2 | 12/2012 | Cann | |
| 8,332,982 | B2 | 12/2012 | Braun et al. | |
| 8,332,985 | B2 | 12/2012 | Solanki | |
| 8,382,208 | B2 | 2/2013 | Baertschi et al. | |
| 8,448,284 | B2 | 5/2013 | Gross et al. | |
| 8,448,287 | B2 | 5/2013 | Ponzini et al. | |
| 8,458,846 | B2 | 6/2013 | Schamberg et al. | |
| 8,484,789 | B2 | 7/2013 | Claire-Zimmet et al. | |
| 8,500,766 | B2 | 8/2013 | Jimenez et al. | |
| 8,528,148 | B2 | 9/2013 | Brown, Jr. et al. | |
| 8,595,886 | B2 | 12/2013 | Edelstein et al. | |
| 8,601,635 | B2 | 12/2013 | Goldman et al. | |
| 8,608,251 | B2 | 12/2013 | Nirwing et al. | |
| 8,621,698 | B2 | 1/2014 | Chenvainu et al. | |
| 8,631,534 | B2 | 1/2014 | Blanchard et al. | |
| 8,732,890 | B2 | 5/2014 | Mohr et al. | |
| 8,739,351 | B2 | 6/2014 | Kling et al. | |
| 8,776,302 | B2 | 7/2014 | Baertschi et al. | |
| 8,813,292 | B2 | 8/2014 | Driesen et al. | |
| 9,398,802 | B2 | 7/2016 | Moskovich et al. | |
| 2002/0017003 | A1 | 2/2002 | Kramer et al. | |
| 2002/0138928 | A1 | 10/2002 | Calabrese | |
| 2003/0163881 | A1 | 9/2003 | Driesen et al. | |
| 2003/0178745 | A1 | 9/2003 | Scarabelli et al. | |
| 2003/0178885 | A1 | 9/2003 | Weihrauch | |
| 2004/0025275 | A1 | 2/2004 | Moskovich et al. | |
| 2004/0107521 | A1 | 6/2004 | Chan et al. | |
| 2004/0134007 | A1 | 7/2004 | Davies | |
| 2005/0166343 | A1 | 8/2005 | Gavney, Jr. | |
| 2005/0210612 | A1 | 9/2005 | Hohlbein et al. | |
| 2006/0048314 | A1 | 3/2006 | Kressner | |
| 2006/0048323 | A1 | 3/2006 | Rueb | |
| 2006/0064827 | A1 | 3/2006 | Chan | |
| 2006/0123574 | A1 | 6/2006 | Storkel et al. | |
| 2006/0236477 | A1 | 10/2006 | Gavney, Jr. | |
| 2006/0236478 | A1 | 10/2006 | Hohlbein et al. | |
| 2006/0248667 | A1 | 11/2006 | Kraemer | |
| 2007/0151058 | A1 | 7/2007 | Kraemer et al. | |
| 2007/0169295 | A1 | 7/2007 | Winter et al. | |
| 2007/0265555 | A1 | 11/2007 | Deng | |
| 2007/0283517 | A1 | 12/2007 | Blanchard et al. | |
| 2009/0007357 | A1 | 1/2009 | Meadows et al. | |
| 2009/0038097 | A1 | 2/2009 | Geiberger | |
| 2009/0158543 | A1 | 6/2009 | Lee | |
| 2009/0255077 | A1 | 10/2009 | Mori et al. | |
| 2009/0282628 | A1* | 11/2009 | Braun | A46B 15/0002 15/22.1 |
| 2010/0043162 | A1 | 2/2010 | Kling et al. | |
| 2010/0058550 | A1 | 3/2010 | Ballmaier et al. | |
| 2010/0088836 | A1 | 4/2010 | Kirchhofer et al. | |
| 2010/0101037 | A1 | 4/2010 | Hilfiker et al. | |
| 2010/0115724 | A1* | 5/2010 | Huang | A46B 9/025 15/167.1 |
| 2010/0180392 | A1 | 7/2010 | Binet et al. | |
| 2010/0223746 | A1 | 9/2010 | Mueller | |
| 2010/0263149 | A1 | 10/2010 | Ballmaier et al. | |
| 2010/0306941 | A1 | 12/2010 | Erskine-Smith et al. | |
| 2011/0030160 | A1 | 2/2011 | Knutzen et al. | |
| 2011/0047736 | A1* | 3/2011 | Jimenez | A46B 9/04 15/167.2 |
| 2011/0138560 | A1 | 6/2011 | Vitt et al. | |
| 2011/0146014 | A1* | 6/2011 | Jimenez | A46B 9/04 15/167.1 |
| 2011/0219558 | A1 | 9/2011 | Vitt et al. | |
| 2011/0109149 | A1 | 12/2011 | Loetscher et al. | |
| 2012/0034576 | A1 | 2/2012 | Mostafa | |
| 2012/0192369 | A1 | 8/2012 | Mohr et al. | |
| 2013/0007968 | A1 | 1/2013 | Driesen et al. | |
| 2013/0036566 | A1 | 2/2013 | Schlatter | |
| 2013/0139338 | A1* | 6/2013 | Hess | A46B 9/026 15/167.1 |
| 2013/0269128 | A1 | 10/2013 | Jimenez | |
| 2013/0291320 | A1 | 11/2013 | Kirchhofer et al. | |
| 2013/0333126 | A1 | 12/2013 | Miller | |
| 2014/0047656 | A1 | 2/2014 | Newman et al. | |
| 2014/0158152 | A1 | 6/2014 | Kirchhofer et al. | |
| 2014/0173838 | A1 | 6/2014 | Dickie et al. | |
| 2014/0173853 | A1 | 6/2014 | Kirchhofer et al. | |
| 2014/0298605 | A1 | 10/2014 | Ivory | |
| 2014/0310901 | A1 | 10/2014 | Geiberger et al. | |
| 2015/0150367 | A1* | 6/2015 | Moskovich | A46B 9/04 15/167.1 |
| 2015/0327666 | A1* | 11/2015 | Hohlbein | A46B 3/06 300/21 |
| 2016/0166051 | A1* | 6/2016 | Shokoohi | A46B 9/04 15/167.1 |

FOREIGN PATENT DOCUMENTS

| | | |
|---|---|---|
| BR | 7900283 | 8/2000 |
| BR | DI 6601454-9 | 4/2006 |
| BR | DI 6702593 | 8/2007 |
| BR | DI 6805210-3 | 11/2008 |
| BR | DI 6902120-1 | 5/2009 |
| BR | DI 6903329-3 | 8/2009 |
| BR | DI 6903330-7 | 8/2009 |
| BR | DI 6904386 | 11/2009 |
| BR | DI 7102178-7 | 4/2011 |
| BR | 30 2013 000448-1 | 2/2013 |
| BR | DI 6401609-9 | 5/2014 |
| CH | 215110 | 6/1941 |
| CN | 3372860D | 6/2004 |
| CN | 3372861D | 6/2004 |
| CN | 2732059 | 10/2005 |
| CN | 300704339 | 10/2007 |
| CN | 201294969 | 8/2009 |
| CN | 201518876 | 7/2010 |
| CN | 201518877 | 7/2010 |
| CN | 201518880 | 7/2010 |
| CN | 201528796 | 7/2010 |
| CN | 201541995 | 8/2010 |
| CN | 201541996 | 8/2010 |
| CN | 201541997 | 8/2010 |
| CN | 201550827 | 8/2010 |
| CN | 301406316 S | 12/2010 |
| CN | 301421505 S | 12/2010 |
| CN | 201814085 | 5/2011 |
| CN | 201986933 | 9/2011 |
| CN | 301763519 | 12/2011 |
| CN | 30198826 | 5/2012 |
| CN | 302058056 | 9/2012 |
| CN | 302225957 S | 12/2012 |
| CN | 302328863 S | 2/2013 |
| CN | 202800555 | 3/2013 |
| CN | 103005839 | 4/2013 |
| CN | 203194906 | 9/2013 |
| CN | 203220069 | 10/2013 |
| CN | 203220073 | 10/2013 |
| CN | 203252150 | 10/2013 |
| CN | 302956580 S | 10/2014 |
| DE | 19858102 | 6/2000 |
| DE | 202005009026 | 10/2005 |

(56) References Cited

FOREIGN PATENT DOCUMENTS

| | | |
|---|---|---|
| DE | 102006016939 | 5/2007 |
| DE | 102006005616 | 8/2007 |
| DE | 102006024874 | 11/2007 |
| DE | 202008016004 | 2/2009 |
| EM | 000366984-0001 | 7/2005 |
| EM | 000638028-0002 | 12/2006 |
| EM | 001975079-0005 | 1/2012 |
| EM | 002163675-0002 | 1/2013 |
| EM | 002163675-0003 | 1/2013 |
| EM | 002212522-0004 | 4/2013 |
| EM | 002212522-0012 | 4/2013 |
| EM | 002424069-0001 | 3/2014 |
| EP | 0716821 | 6/1996 |
| EP | 0769920 | 9/2003 |
| EP | 2810581 | 12/2014 |
| ES | 1063617 | 11/2006 |
| IT | 2010PDO000035-0019 | 10/2010 |
| JP | H08164025 | 6/1996 |
| JP | 10042957 | 8/1996 |
| JP | D1314270 | 10/2007 |
| KR | 20040032038 | 4/2004 |
| KR | 838174 | 6/2007 |
| KR | 20-2012-0005449 | 7/2012 |
| MX | 32553 | 11/2009 |
| MX | 36113 | 4/2011 |
| MX | 36650 | 4/2011 |
| RU | 55985 | 1/2005 |
| RU | 79787 | 10/2011 |
| RU | 80086 | 11/2011 |
| RU | 81915 | 6/2012 |
| WO | WO1995/06420 | 3/1995 |
| WO | WO1995/10959 | 4/1995 |
| WO | WO1999/023910 | 5/1999 |
| WO | WO1999/55514 | 11/1999 |
| WO | WO1999/65358 | 12/1999 |
| WO | WO2000/49911 | 8/2000 |
| WO | WO2001/17392 | 3/2001 |
| WO | WO2001/29128 | 4/2001 |
| WO | WO2001/45573 | 6/2001 |
| WO | WO2001/182741 | 11/2001 |
| WO | WO2004/043669 | 5/2004 |
| WO | WO2005/122827 | 12/2005 |
| WO | WO2008/017996 | 2/2008 |
| WO | WO2011/070549 | 6/2011 |
| WO | WO2012/017923 | 2/2012 |
| WO | WO2012/099230 | 7/2012 |
| WO | WO2012/115035 | 8/2012 |
| WO | WO2012/176741 | 12/2012 |
| WO | WO2013/031685 | 3/2013 |

OTHER PUBLICATIONS

International Search Report and the Written Opinion issued in International Application PCT/US2012/070760 dated Oct. 14, 2013.

International Search Report and the Written Opinion of the International Searching Authority issued in International Application PCT/US2014/072038 dated Sep. 15, 2015.

* cited by examiner

ORAL CARE IMPLEMENT

BACKGROUND

A toothbrush is used to clean the teeth by removing plaque and debris from the tooth surfaces. Conventional toothbrushes having a flat bristle trim are limited in their ability to conform to the curvature of the teeth, to penetrate into the interproximal areas between the teeth, to sweep away the plaque and debris, and to clean along the gum line. Additionally, such toothbrushes have a limited ability to retain dentifrice for cleaning the teeth. During the brushing process, the dentifrice typically slips through the tufts of bristles and away from the contact between the bristles and the teeth. As a result, the dentifrice is often spread around the mouth, rather than being concentrated on the contact of the bristles with the teeth. Therefore, the efficiency of the cleaning process is reduced.

While substantial efforts have been made to modify the cleaning elements of toothbrushes to improve the efficiency of the oral cleaning process, the industry continues to pursue arrangements of cleaning elements that will improve upon the existing technology. In typical oral care implements, bristles having circular transverse cross-sectional profiles are bundled together in a bristle tuft and mounted within tuft holes having circular transverse cross-sectional profiles. However, such a configuration results in gaps being present between adjacent bristles in the tuft and between the bristles of the tuft and the walls of the tuft holes, thereby resulting in a looser packing of the tuft hole and a less than optimal packing factor. These gaps can also reduce the effectiveness of the oral care implement and can cause the oral care implement to effectuate an uncomfortable feeling during brushing. Therefore, a need exists for an oral care implement having an improved arrangement of bristles.

BRIEF SUMMARY

The present invention is directed to an oral care implement that includes a handle and a head with a front surface. A plurality of tooth cleaning elements extend from the front surface. In one embodiment the plurality of tooth cleaning elements include a conical tuft that is formed by a continuous wall of bristles. The tooth cleaning elements may also include first and/or second sets of peripheral tooth cleaning elements located adjacent to opposing lateral edges of the head. The peripheral tooth cleaning elements may include elastomeric sleeve portions and bristle tuft portions. The elastomeric sleeve portions may be formed as a part of an integrally formed elastomeric component.

In one aspect, the invention can be an oral care implement comprising: a handle; a head coupled to the handle, the head comprising a front surface and a longitudinal axis extending from a proximal end of the head to a distal end of the head; a plurality of tooth cleaning elements extending from the front surface of the head; the plurality of tooth cleaning elements comprising a conical tuft comprising a bristle wall having an inner surface defining a cavity along a cavity axis, the cavity having a transverse cross-sectional area that increases with distance from the front surface of the head, the conical tuft terminating in an annular top surface, the annular top surface being a first height from the front surface of the head; the plurality of tooth cleaning element further comprising: a first set of peripheral tooth cleaning elements located adjacent to a first lateral edge of the head; a second set of peripheral tooth cleaning elements located adjacent to a second lateral edge of the head; and each peripheral tooth cleaning element of the first and second sets comprising an elastomeric sleeve portion and a bristle tuft portion extending through a sleeve cavity of the elastomeric sleeve portion along a sleeve axis, the bristle tuft portion protruding from a distal end of the elastomeric sleeve portion.

In another aspect, the invention can be an oral care implement comprising: a handle; a head coupled to the handle and comprising a front surface; a plurality of tooth cleaning elements extending from the front surface of the head; the plurality of tooth cleaning elements comprising a first set of peripheral tooth cleaning elements located adjacent to a first lateral edge of the head, each of the peripheral tooth cleaning elements of the first set comprising an elastomeric sleeve portion and a bristle tuft portion protruding from the elastomeric sleeve portion; one or more first channels in the front surface of the head that extend between adjacent ones of the peripheral tooth cleaning elements of the first set; an integrally formed elastomeric component comprising: the elastomeric sleeve portions of the first set of the peripheral tooth cleaning elements; and one or more first elastomeric sleeve strips that extend between and connect the elastomeric sleeve portions of adjacent ones of the peripheral tooth cleaning elements of the first set, the one or more first elastomeric sleeve strips located within the one or more first channels.

In yet another aspect, the invention can be an oral care implement comprising: a handle; a head coupled to the handle and comprising a head plate, the head plate comprising a lower surface, an upper surface that forms a front surface of the head, and a plurality of through holes extending from the lower surface of the head plate to the upper surface of the head plate; one or more channels in the lower surface of the head plate; one or more channels in the upper surface of the head plate; a plurality of bristle tufts extending through the plurality of through holes, each of the plurality of bristle tufts comprising a cleaning portion protruding from the upper surface of the head plate and a melt matte located adjacent the lower surface of the head plate; an integrally formed elastomeric component comprising a plurality of elastomeric elements protruding from the upper surface of the head plate, one or more elastomeric strips disposed within the one or more channels in the lower surface of the head plate that connect at least two of the plurality of elastomeric elements, and one or more elastomeric strips disposed within the one or more channels in the upper surface of the head plate that connect at least two of the plurality of elastomeric elements.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
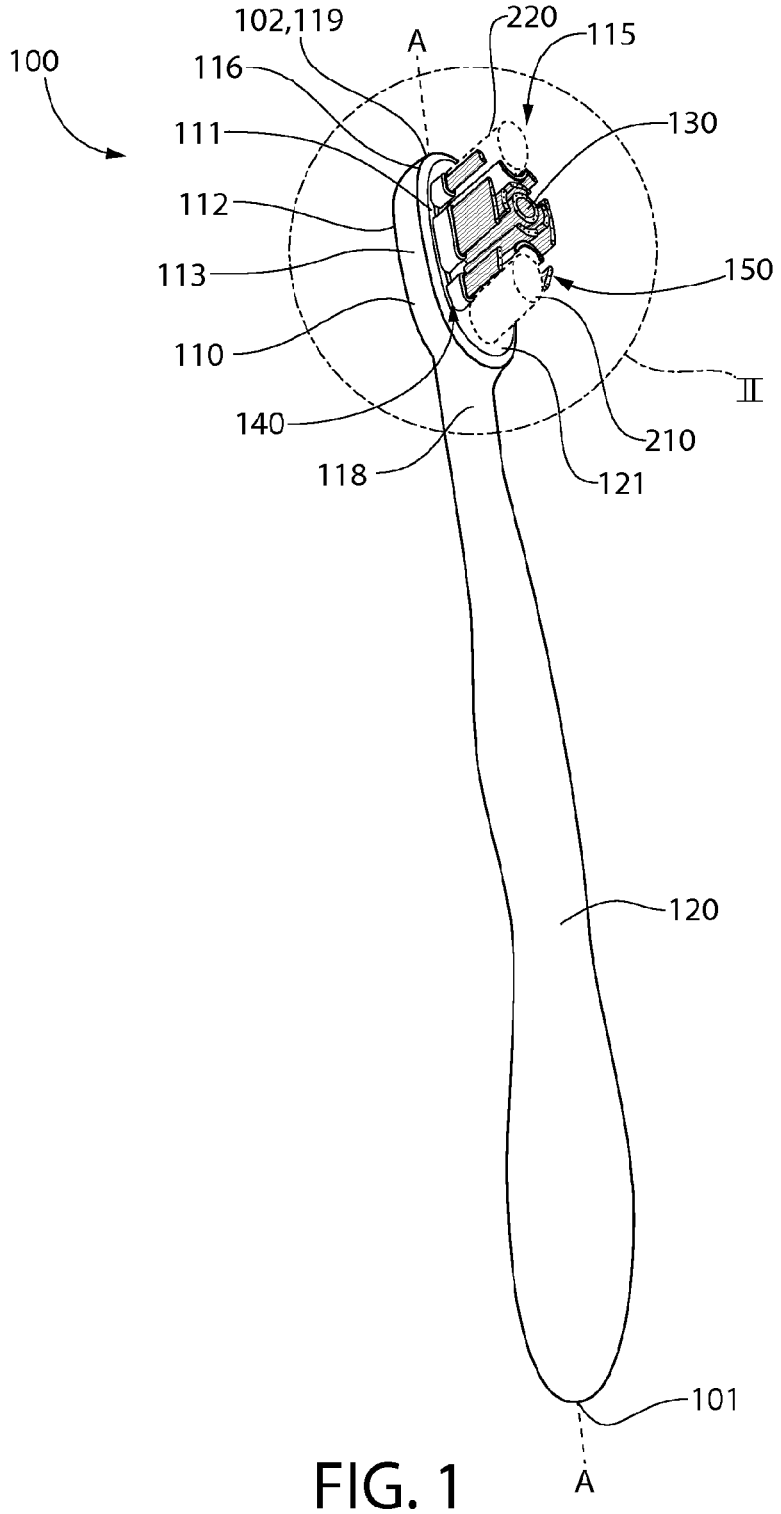
FIG. 1 is a front perspective view of an oral care implement in accordance with one embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Figure 2:
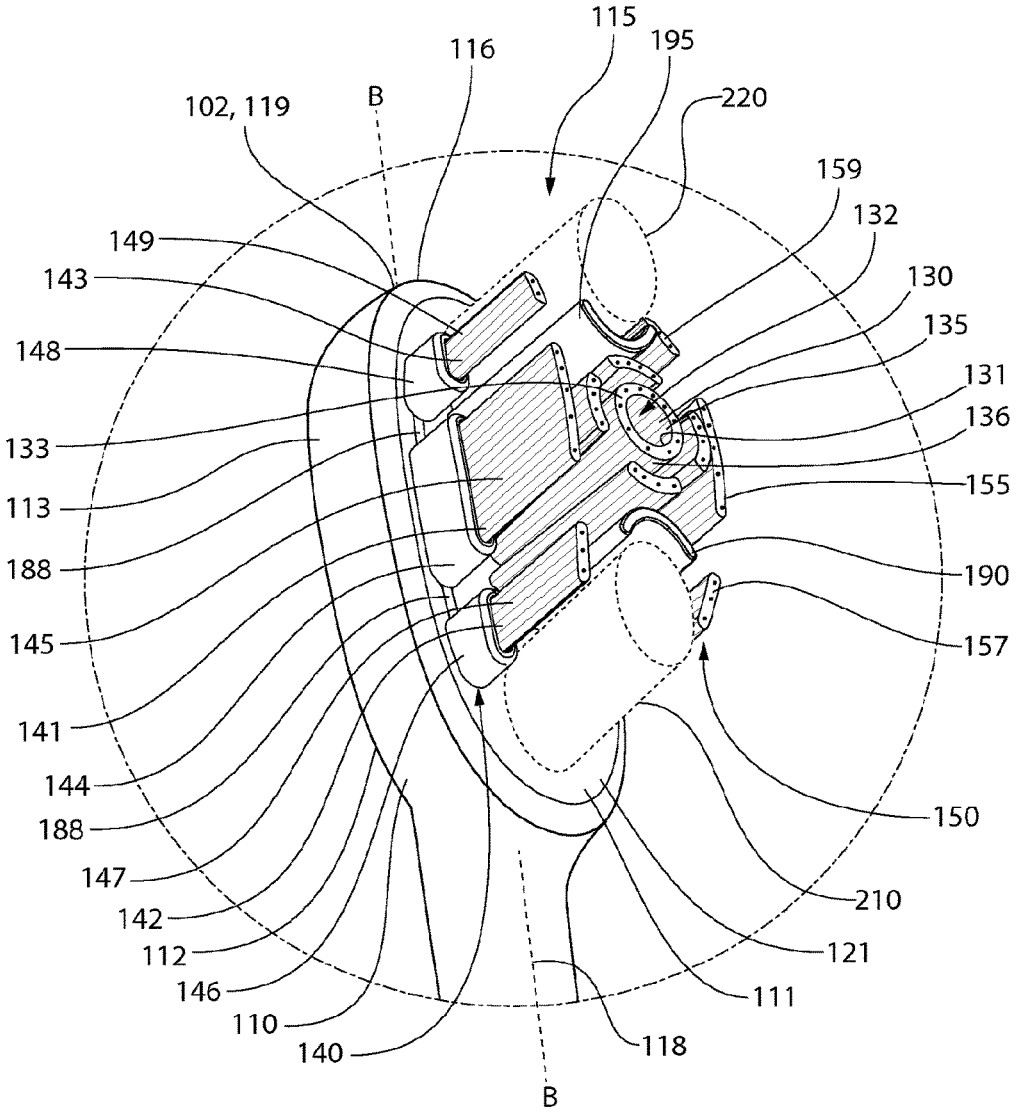
FIG. 2 is a close-up view of a head of the oral care implement of FIG. 1 as indicated by area II of FIG. 1.
Figure 3:
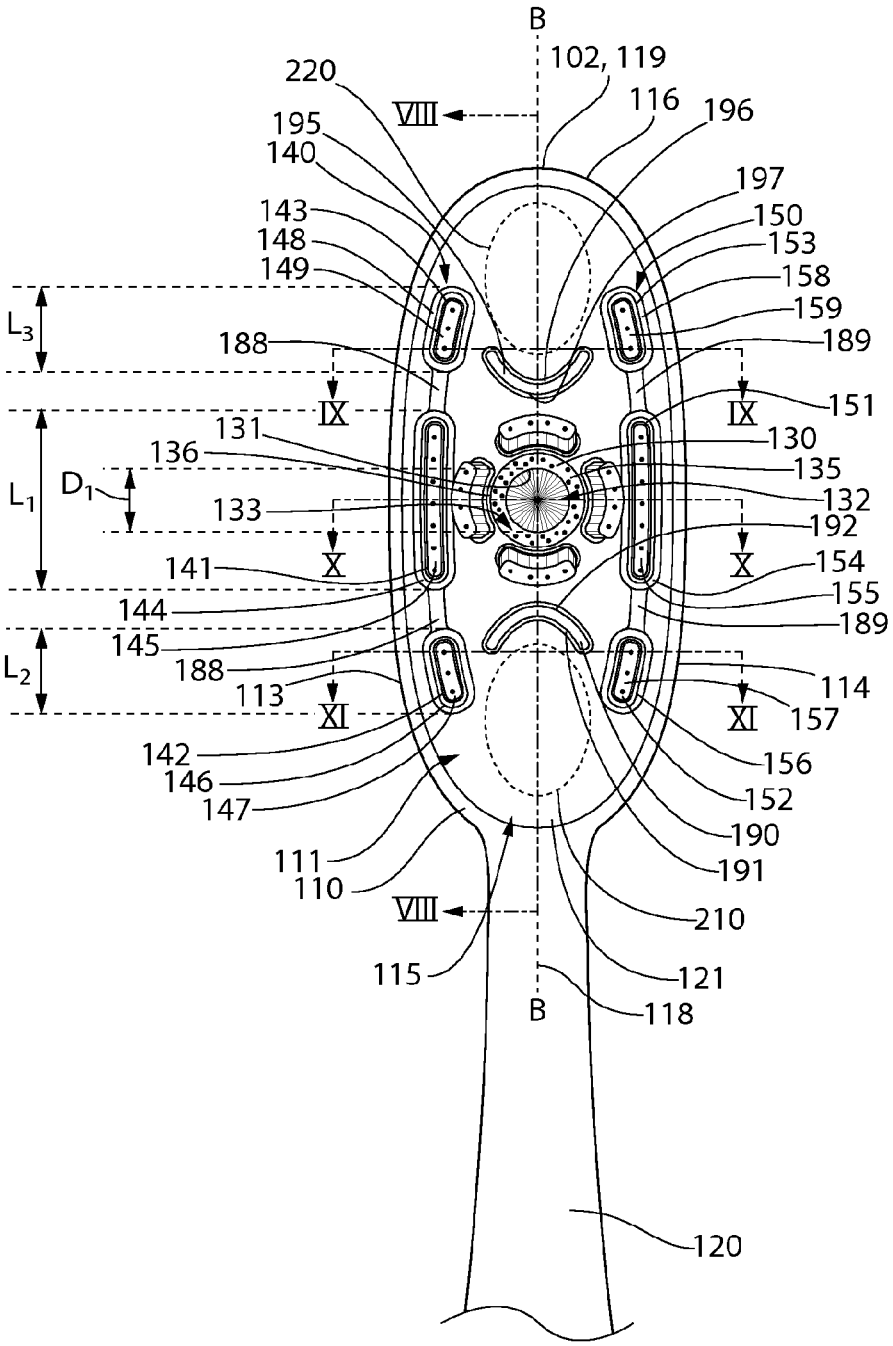
FIG. 3 is a front view of the head of the oral care implement of FIG. 2.

Referring first to FIGS. 1-3 concurrently, an oral care implement 100 is illustrated in accordance with one embodiment of the present invention. In the exemplified embodiment, the oral care implement 100 is in the form of a manual toothbrush. However, in certain other embodiments the oral care implement 100 can take on other forms such as being a powered toothbrush, a tongue scraper, a gum and soft tissue cleanser, a water pick, an interdental device, a tooth polisher, a specially designed ansate implement having tooth engaging elements, or any other type of implement that is commonly used for oral care. Thus, it is to be understood that the inventive concepts discussed herein can be applied to any type of oral care implement unless a specific type of oral care implement is specified in the claims.

The oral care implement 100 extends from a proximal end 101 to a distal end 102 along a longitudinal axis A-A. The oral care implement 100 generally comprises a head 110 and a handle 120. The head 110 extends from a proximal end 118 to a distal end 119 along a longitudinal axis B-B that is coextensive with the longitudinal axis A-A of the oral care implement 100. Furthermore, in the exemplified embodiment the distal end 102 of the oral care implement 100 is the same as the distal end 119 of the head 110.

The handle 120 is an elongated structure that provides the mechanism by which the user can hold and manipulate the oral care implement 100 during use. In the exemplified embodiment, the handle 120 is generically depicted having various contours for user comfort. Of course, the invention is not to be limited by the specific shape illustrated for the handle 120 in all embodiments and in certain other embodiments the handle 120 can take on a wide variety of shapes, contours, and configurations, none of which are limiting of the present invention unless so specified in the claims.

In the exemplified embodiment, the handle 120 is formed of a rigid plastic material, such as for example without limitation polymers and copolymers of ethylene, propylene, butadiene, vinyl compounds, and polyesters such as polyethylene terephthalate. Of course, the invention is not to be so limited in all embodiments and the handle 120 may include a resilient material, such as a thermoplastic elastomer, as a grip cover that is molded over portions of or the entirety of the handle 120 to enhance the gripability of the handle 120 during use. For example, portions of the handle 120 that are typically gripped by a user's palm during use may be overmolded with a thermoplastic elastomer or other resilient material to further increase comfort to a user. Furthermore, materials other than those noted above can be used including metal, wood, or any other desired material that has sufficient structural rigidity to permit a user to grip the handle 120 and manipulate the oral care implement 100 during toothbrushing.

The head 110 of the oral care implement 100 is coupled to the handle 120 and comprises a front surface 111 and an opposing rear surface 112. Furthermore, the head 110 has a peripheral side surface extending between the front and rear surfaces 111, 112. The peripheral side surface of the head 110 includes a first lateral edge 113, a second lateral edge 114, and a distal edge 116. In the exemplified embodiment, the head 110 is formed integrally with the handle 120 as a single unitary structure using a molding, milling, machining, or other suitable process. However, in other embodiments the handle 120 and the head 110 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. Thus the head 110 may, in certain embodiments, be formed of any of the rigid plastic materials described above as being used for forming the handle 120, although the invention is not to be so limited in all embodiments and other materials that are commonly used during toothbrush head manufacture may also be used.

The oral care implement 100 also comprises a plurality of tooth cleaning elements 115 extending from the front surface 111 of the head 110. The details of certain ones of the plurality of tooth cleaning elements 115 will be discussed below, including specific details with regard to the structure, pattern, orientation, and material of such tooth cleaning elements 115. However, where it does not conflict with the other disclosure provided herein, it should be appreciated that the term "tooth cleaning elements" may be used in a generic sense to refer to any structure that can be used to clean, polish, or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, spiral bristles, rubber bristles, elastomeric protrusions, flexible polymer protrusions, combinations thereof and/or structures containing such materials or combinations. Thus, any combination of these tooth cleaning elements may be used within the tooth cleaning elements 115 in some embodiments. However, as described herein below, in certain embodiments one or more of the tooth cleaning elements 115 may be formed as tufts of bristles.

In embodiments that use elastomeric elements as one or more of the tooth cleaning elements 115, suitable elastomeric materials may include any biocompatible resilient material suitable for uses in an oral hygiene apparatus. To provide optimum comfort as well as cleaning benefits, the elastomeric material of any such tooth or soft tissue engaging elements may have a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

Referring now to FIGS. 1-4 and 8-11 concurrently, one manner in which the tooth cleaning elements 115 are secured to the head 110 will be described. Specifically, in the exemplified embodiment the tooth cleaning elements 115 are formed as a cleaning element assembly on a head plate 121 such that one or more of the tooth cleaning elements 115 are mounted onto the head plate 121 and then the head plate 121 is coupled to or secured to the head 110. The head plate 121 has a lower surface 123 and an upper surface 124, the upper surface 124 forming a portion of (or in some instances the entirety of) the front surface 111 of the head 110. In embodiments that use the head plate 121, the head plate 121 is a separate and distinct component from the head 110 of the oral care implement 100. However, the head plate 121 is connected to the head 110 at a later stage of the manufacturing process by any suitable technique known in the art, including without limitation thermal or ultrasonic welding, any fusion techniques such as thermal fusion, melting, a tight-fit assembly, a coupling sleeve, threaded engagement, adhesion, or fasteners. Thus, the head plate 121 and the head 110 are separately formed components that are secured together during manufacture of the oral care implement 100.

In certain embodiments, the head plate 121 may comprise a plurality of holes 122 formed therethrough, and the tooth cleaning elements 115 may be mounted to the head plate 121 within the holes 122. This type of technique for mounting the tooth cleaning elements 115 to the head 110 via the head plate 121 is generally known as anchor free tufting (AFT). Specifically, in AFT a plate or membrane (i.e., the head plate 121) is created separately from the head 110. The tooth cleaning elements 115 (such as bristles, elastomeric elements, and combinations thereof) are positioned into the head plate 121 so as to extend through the holes 122 of the head plate 121. The free ends of the tooth cleaning elements 115 on one side of the head plate 121 perform the cleaning function. The ends of the tooth cleaning elements 115 on the other side of the head plate 121 are melted together by heat to be anchored in place. As the tooth cleaning elements 105 are melted together, a melt matte 106 is formed. After the tooth cleaning elements 115 are secured to the head plate 121, the head plate 121 is secured to the head 110 such as by ultrasonic welding. When the head plate 121 is coupled to the head 110, the melt matte 106 is located between the lower surface 123 of the head plate 121 and a floor 107 of a basin 108 of the head 110 in which the head plate 121 is disposed. The melt matte 106, which is coupled directly to and in fact forms a part of the tooth cleaning elements 115, prevents the tooth cleaning elements 115 from being pulled through the holes 122 in the head plate 121 to ensure that the tooth cleaning elements 105 remain attached to the head plate 121 during use of the oral care implement 100.

In another embodiment, the tooth cleaning elements may be connected to the head 110 using a technique known in the art as AMR. In this technique, the handle is formed integrally with the head plate as a one-piece structure (thus, the head plate actually forms an upper portion of the head to which the cleaning elements are attached, as noted herein below). After the handle and head plate are formed, the bristles are inserted into holes in the head plate so that free/cleaning ends of the bristles extend from the front surface of the head plate and bottom ends of the bristles are adjacent to the rear surface of the head plate. After the bristles are inserted into the holes in the head plate, the bottom ends of the bristles are melted together by applying heat thereto, thereby forming a melt matte at the rear surface of the head plate. The melt matte is a thin layer of plastic that is formed by melting the bottom ends of the bristles so that the bottom ends of the bristles transition into a liquid, at which point the liquid of the bottom ends of the bristles combine together into a single layer of liquid plastic that at least partially covers the rear surface of the head plate. After the heat is no longer applied, the melted bottom ends of the bristles solidify/harden to form the melt matte/thin layer of plastic (this same process occurs in the formation of the melt matte 106 described above with regard to AFT). In some embodiments, after formation of the melt matte, a tissue cleaner is injection molded onto the rear surface of the head plate, thereby trapping the melt matte between the tissue cleaner and the rear surface of the head plate. In other embodiments, other structures may be coupled to the rear surface of the head plate to trap the melt matte between the rear surface of the head plate and such structure without the structure necessarily being a tissue cleaner (the structure can just be a plastic material that is used to form a smooth rear surface of the head, or the like).

Although described herein above with regard to using AFT or AMR, in certain embodiments any suitable form of cleaning elements and attachment may be used in the broad practice of this invention. Specifically, the tooth cleaning elements 115 of the present invention can be connected to the head 110 in any manner known in the art. For example, staples/anchors or in-mold tufting (IMT) could be used to mount the cleaning elements/tooth engaging elements. In certain embodiments, the invention can be practiced with various combinations of stapled, IMT or AFT bristles. Alternatively, the tooth cleaning elements 115 could be mounted to tuft blocks or sections by extending through suitable openings in the tuft blocks so that the base of the tooth cleaning elements 115 is mounted within or below the tuft block. Furthermore, in a modified version of the AFT process discussed above, the head plate 121 may be formed by positioning the tooth cleaning elements 115 within a mold, and then molding the head plate 121 around the tooth cleaning elements 115 via an injection molding process.

Although not illustrated herein, in certain embodiments the head 110 may also include a soft tissue cleanser coupled to or positioned on its rear surface 112. An example of a suitable soft tissue cleanser that may be used with the present invention and positioned on the rear surface of the head 110 is disclosed in U.S. Pat. No. 7,143,462, issued Dec. 5, 2006 to the assignee of the present application, the entirety of which is hereby incorporated by reference. In certain other embodiments, the soft tissue cleanser may include protuberances, which can take the form of elongated ridges, nubs, or combinations thereof. Of course, the invention is not to be so limited and in certain embodiments the oral care implement 100 may not include any soft tissue cleanser.

Referring to FIGS. 1-3, 7, and 8 concurrently, the plurality of tooth cleaning elements 115 of the oral care implement 100 will be further described. In the exemplified embodiment, the plurality of tooth cleaning elements 115 comprises a conical tuft 130. The conical tuft 130 is a tuft or grouping of bristles that are arranged together into a tuft and then secured into a single tuft hole within the head 110 (or within the head plate 121). The conical tuft 130 is described herein as being conical due to the conical tuft 130 having a conical shape. Thus, as can best be seen in FIG. 10, the bristles of the conical tuft 130 converge and form an apex that is located within the tuft hole within which the conical tuft 130 is positioned. The apex may be located at the upper surface 124 of the head plate 121, within the tuft hole of the head plate 121 between the upper and lower surfaces 123, 124, or near the lower surface 123 of the head plate 121. In other embodiments the apex may be located above the upper surface 124 of the head plate 121. In still other embodiments, the conical tuft 130 may be in the shape of a truncated cone wherein the portion of the conical tuft 130 that is positioned within the head 110 is the truncated (i.e., cut off) portion of the cone such that the conical tuft 130 is in the shape of an inverted truncated cone. In such an embodiment, the bristles of the conical tuft 130 will not converge prior to reaching the melt matte 106.

The conical tuft 130 comprises a continuous bristle wall 135 having an inner surface 131 and an outer surface 136. The outer surface 136 of the conical tuft 130 is oriented at an acute angle relative to the front surface 111 of the head 110. In one embodiment, the acute angle may be between 80° and 89°, more specifically between 82° and 85°, or between 86° and 89°, or between 83.5° and 87.5°.

Furthermore, the conical tuft 130 terminates in an annular top surface 133 that is located at a first height $H_1$ from the front surface 111 of the head 110. The inner surface 131 of the continuous bristle wall 135 of the conical tuft 130 defines a cavity 132 that extends along a cavity axis C-C. The conical tuft 130 extends in a 360° manner about the cavity axis C-C. The cavity 132 of the conical tuft 130 has an open top end and is bounded by the inner surface 131 of the continuous bristle wall 135 and by the front surface 111 of the head 110. As noted above, the conical tuft 130 in the exemplified embodiment is formed by a plurality of bristles. Specifically, the plurality of bristles are clumped together and positioned collectively into a single tuft hole so that the plurality of bristles collectively form the conical tuft 130 having no gaps in the continuous bristle wall 135 for its entire 360° extension about the cavity axis C-C. Thus, the term continuous bristle wall 135 is intended to mean that the conical tuft 130 is a single tuft of bristles that are clumped together into a single tuft hole in a non-spaced apart manner. However, the invention is not to be limited to the bristle wall 135 being continuous in all embodiments.

Thus, in the exemplified embodiment the conical tuft 130 is a single tuft formed from a plurality of individual bristles that are positioned together within a single tuft hole. As a result, in the exemplified embodiment the conical tuft 130 has the continuous bristle wall 135 that extends without discontinuity about the cavity axis C-C. Thus, in the exemplified embodiment there are no gaps formed into the outer surface 136 of the conical tuft 130. Of course, in other embodiments the conical tuft 130 may have small gaps therein as desired while still being a single tuft positioned within a single tuft hole. In such an embodiment, the bristle wall may not be considered continuous. Such gaps in the bristle wall may prevent dentifrice from being trapped within the cavity 132 of the conical tuft 130 by providing means of egress from the cavity 132.

Figure 10:
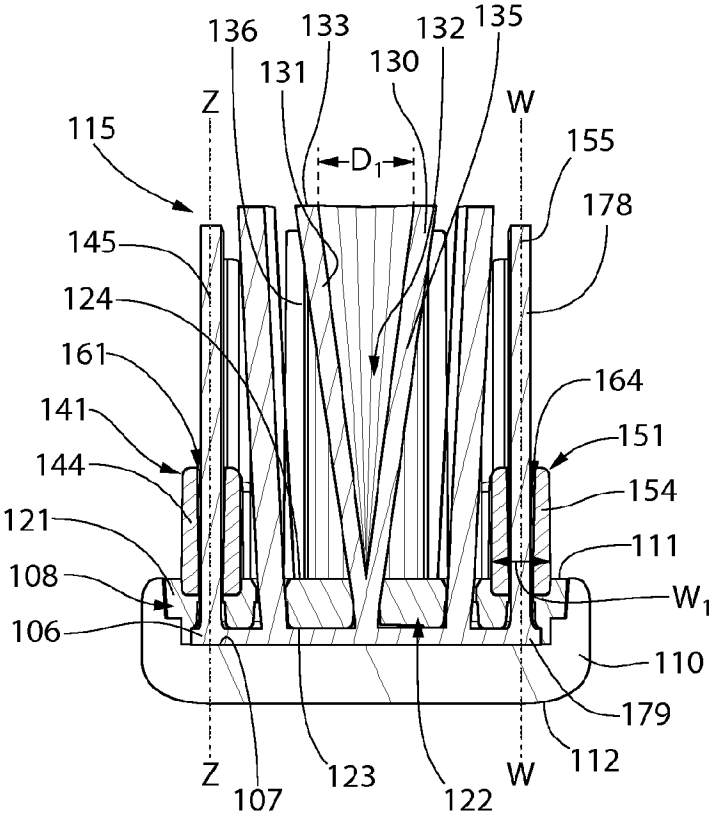
FIG. 10 is a cross-sectional view taken along line X-X of FIG. 3.

Due to the conical shape of the conical tuft 130, and more specifically, the inverted conical shape of the conical tuft 130, the cavity 132 of the conical tuft 130 has a transverse cross-sectional area that increases with distance from the front surface 111 of the head 110. Specifically, the transverse cross-sectional area of the cavity 132 of the conical tuft 130 only increases and never decreases with distance from the front surface 111 of the head 110. Thus, the greater the distance between a particular axial location within the cavity 132 of the conical tuft 130 and the front surface 111 of the head 110, the greater the transverse cross-sectional area of the cavity 132 at that particular axial location. Referring briefly to FIGS. 3 and 10, the transverse cross-sectional area of the cavity 132 of the conical tuft 130 has a maximum diameter $D_1$ located at the annular top surface 133 of the conical tuft 130.

Although not illustrated in the exemplified embodiment, in certain embodiments the oral care implement 100 may include a central cleaning element that is located within the cavity 132 of the conical tuft 130. In such an embodiment, the conical tuft 130 may surround the central cleaning element. Using the conical tuft 130 in conjunction with a central cleaning element may enhance cleaning by enabling the conical tuft 130 to surround a user's tooth while the central cleaning element cleans in the interproximal areas and the spaces between the teeth and gums. In one exemplary embodiment, the central cleaning element may be a bristle tuft, although the invention is not to be so limited in all embodiments and in certain other embodiments the central cleaning element may be an elastomeric element or the like as discussed above. Furthermore, the central cleaning element may be formed with tapered bristles, rounded/non-tapered bristles, spiral bristles, or combinations thereof. In an embodiment that includes a central tuft, the conical tuft 130 and the central cleaning element may be secured to the head 110 by anchor free tufting. Specifically, the ends of the bristles that form the conical tuft 130 and the ends of the bristles that form the central cleaning element may be melted together to form at least a portion of the melt matte 106 as discussed above.

As noted above, the head 110 extends along the longitudinal axis B-B from its proximal end 118 to its distal end 119. In the exemplified embodiment, the conical tuft 130 is aligned on the longitudinal axis. Furthermore, in the exemplified embodiment the conical tuft 130 is also aligned along a transverse axis that is perpendicular to the longitudinal axis B-B and that divides the head 110 into two equal halves. Thus, in the exemplified embodiment the conical tuft 130 is centrally located on the head 110. Of course, in other embodiments the conical tuft 130 can be positioned at other locations on the head 110 as desired, such as being located along the longitudinal axis B-B and at the proximal or distal ends of the head 110, or the like. Furthermore, in some embodiments more than one conical tuft may be included on the head 110. In the exemplified embodiment, a set of four arcuate tooth cleaning elements are arranged so as to form a loop that substantially surrounds the conical tuft 130. Each of the four arcuate tooth cleaning elements has a concave surface facing the conical tuft 130 and a convex surface facing away from the conical tuft 130. The four arcuate tooth cleaning elements are adjacent to the conical tuft 130 such that there are no cleaning elements positioned on the head in between the concave surfaces of the four arcuate tooth cleaning elements and the outer surface 136 of the conical tuft 130. In the exemplified embodiment, the four arcuate tooth cleaning elements extend from the front surface 111 of the head 110 at the same angle as the outer surface 136 of the conical tuft 130 forms with the front surface 111 of the head 110. However, the four arcuate tooth cleaning elements may be perpendicular to the head 110 or may extend at angles relative to the front surface 111 of the head 110 that are different than the conical tuft 130 in other embodiments.

Still referring to FIGS. 1-3, and 7-11, the plurality of tooth cleaning elements 115 also include a first set of peripheral tooth cleaning elements 140 and a second set of peripheral tooth cleaning elements 150. The first set of peripheral tooth cleaning elements 140 are located on the front surface of the head 111 adjacent to the first lateral edge 113 of the head 110. The second set of peripheral tooth cleaning elements 150 are located on the front surface of the head 111 adjacent to the second lateral edge 114 of the head 110. Each of the first and second sets of peripheral tooth cleaning elements 140, 150 are the peripheral-most cleaning elements on the respective sides of the head 110 such that there are no cleaning elements positioned outboard of the first and second sets of peripheral tooth cleaning elements 140, 150. Stated another way, there are no cleaning elements positioned between the first set of peripheral tooth cleaning elements 140 and the first lateral edge 113 of the head 110 and there are no cleaning elements positioned between the second set of peripheral tooth cleaning elements 150 and the second lateral edge 114 of the head 110. However, the first and second sets of peripheral tooth cleaning elements 140, 150 are set inwardly from the first and second lateral edges 113, 114 of the head 110 such that a portion of the front surface 111 of the head 110 separates the first and second sets of peripheral tooth cleaning elements 140, 150 from the first and second lateral edges 113, 114 of the head 110, respectively.

The first set of peripheral tooth cleaning elements 140 comprises a central peripheral tooth cleaning element 141, a proximal peripheral tooth cleaning element 142, and a distal peripheral tooth cleaning element 143. The central peripheral tooth cleaning element 141 of the first set of peripheral tooth cleaning elements 140 is located axially between the proximal and distal peripheral tooth cleaning elements 142, 143 of the first set of peripheral tooth cleaning elements 140. The second set of peripheral tooth cleaning elements 150 comprises a central peripheral tooth cleaning element 151, a proximal peripheral tooth cleaning element 152, and a distal peripheral tooth cleaning element 153. The central peripheral tooth cleaning element 151 of the second set of peripheral tooth cleaning elements 150 is located axially between the proximal and distal peripheral tooth cleaning elements 152, 153 of the second set of peripheral tooth cleaning elements 150. The central peripheral tooth cleaning elements 141, 151 are longitudinal aligned such that a transverse plane that is perpendicular to the longitudinal axis B-B and to the front surface 111 of the head 110 intersects both of the central peripheral tooth cleaning elements 141, 151. The proximal peripheral tooth cleaning elements 142, 152 are longitudinal aligned such that a transverse plane that is perpendicular to the longitudinal axis B-B and to the front surface 111 of the head 110 intersects both of the proximal peripheral tooth cleaning elements 142, 152. The distal peripheral tooth cleaning elements 143, 153 are longitudinal aligned such that a transverse plane that is perpendicular to the longitudinal axis B-B and to the front surface 111 of the head 110 intersects both of the distal peripheral tooth cleaning elements 143, 153.

Each of the peripheral tooth cleaning elements 141, 142, 143, 151, 152, 153 of the first and second sets 140, 150 comprises an elastomeric sleeve portion and a bristle portion. Thus, the central peripheral tooth cleaning element 141 has an elastomeric sleeve portion 144 and a bristle tuft portion 145, the proximal peripheral tooth cleaning element 142 has an elastomeric sleeve portion 146 and a bristle tuft portion 147, and the distal peripheral tooth cleaning element 143 has an elastomeric sleeve portion 148 and a bristle tuft portion 149. Similarly, the central peripheral tooth cleaning element 151 has an elastomeric sleeve portion 154 and a bristle tuft portion 155, the proximal peripheral tooth cleaning element 152 has an elastomeric sleeve portion 156 and a bristle tuft portion 157, and the distal peripheral tooth cleaning element 153 has an elastomeric sleeve portion 158 and a bristle tuft portion 159.

The bristle tuft portions 145, 147, 149, 155, 157, 159 of each of the peripheral tooth cleaning elements 141, 142, 143, 151, 152, 153 are separately formed of a plurality of bristles that are collected together into a tuft and inserted into a tuft hole. The sleeve portions 144, 146, 148, 154, 156, 158 of the peripheral tooth cleaning elements 141, 142, 143, 151, 152, 153 are formed of an elastomeric material and circumferentially surround at least a portion of its respective bristle tuft portion 145, 147, 149, 155, 157, 159. As will be discussed in more detail below with specific reference to FIGS. 4, 6A, and 6B, in the exemplified embodiment the sleeve portions 144, 146, 148, 154, 156, 158 of the peripheral tooth cleaning elements 141, 142, 143, 151, 152, 153 are formed as an integral mass of elastomeric material. Thus, the sleeve portions 144, 146, 148, 154, 156, 158 of the peripheral tooth cleaning elements 141, 142, 143, 151, 152, 153 are molded together as a single, unitary structure that is affixed, coupled, or molded directly onto the head plate 121.

Furthermore, each of the elastomeric sleeve portions 144, 146, 148, 154, 156, 158 has a sleeve cavity having a sleeve axis. More specifically, the elastomeric sleeve portion 144 of the central peripheral tooth cleaning element 141 of the first set of peripheral tooth cleaning elements 140 has a sleeve cavity 161 extending along a sleeve axis Z-Z. The elastomeric sleeve portion 146 of the proximal peripheral tooth cleaning element 142 of the first set of peripheral tooth cleaning elements 140 has a sleeve cavity 162 extending along a sleeve axis Y-Y. The elastomeric sleeve portion 148 of the proximal peripheral tooth cleaning element 143 of the first set of peripheral tooth cleaning elements 140 has a sleeve cavity 163 extending along a sleeve axis X-X. The elastomeric sleeve portion 144 of the central peripheral tooth cleaning element 151 of the second set of peripheral tooth cleaning elements 150 has a sleeve cavity 164 extending along a sleeve axis W-W. The elastomeric sleeve portion 156 of the proximal peripheral tooth cleaning element 152 of the second set of peripheral tooth cleaning elements 150 has a sleeve cavity 165 extending along a sleeve axis V-V. The elastomeric sleeve portion 158 of the distal peripheral tooth cleaning element 153 of the second set of peripheral tooth cleaning elements 150 has a sleeve cavity 166 extending along a sleeve axis U-U.

Each of the elastomeric sleeve portions 144, 146, 148, 154, 156, 158 has an outer surface and an inner surface, the inner surface defining a hollow interior cavity (i.e., the sleeve cavity). The bristle tuft portions 145, 147, 149, 155, 157, 159 are located within the hollow interior cavities 161-166 of the elastomeric sleeve portions 144, 146, 148, 154, 156, 158 and protrude from the top surfaces of the elastomeric sleeve portions 144, 146, 148, 154, 156, 158 for cleaning a user's teeth and other oral surfaces and from the bottom surfaces of the elastomeric sleeve portions 144, 146, 148, 154, 156, 158 for forming the melt matte 106 or otherwise being secured to the head 110. Thus, the elastomeric sleeve portions 144, 146, 148, 154, 156, 158 circumferentially surround a portion of the bristle tuft portion 145, 147, 149, 155, 157, 159 that is located within its cavity 161-166. The elastomeric sleeve portions 144, 146, 148, 154, 156, 158 provide support for the bristle tuft portions 145, 147, 149, 155, 157, 159 so that more force is required to bend the bristles, which provides for an effective and thorough cleaning of a user's teeth and other oral surfaces. The elastomeric sleeve portions 144, 146, 148, 154, 156, 158 may also provide a wiping action against the teeth surfaces during brushing for an enhanced cleaning effect.

The bristle tuft portion 145 of the central tooth cleaning element 141 of the first set of peripheral tooth cleaning elements 140 is located within and extends through the sleeve cavity 161 of the elastomeric sleeve portion 144 along the sleeve axis Z-Z. The bristle tuft portion 147 of the proximal tooth cleaning element 142 of the first set of peripheral tooth cleaning elements 140 is located within and extends through the sleeve cavity 162 along the sleeve axis Y-Y. The bristle tuft portion 149 of the distal tooth cleaning element 143 of the first set of peripheral tooth cleaning elements 140 is located within and extends through the sleeve cavity 163 along the sleeve axis X-X. Bottom ends of each of the bristle tuft portions 145, 147, 149 are melted together to form a portion of the melt matte 106 as discussed above.

The bristle tuft portion 155 of the central tooth cleaning element 151 of the second set of peripheral tooth cleaning elements 150 is located within and extends through the sleeve cavity 164 along the sleeve axis W-W. The bristle tuft portion 157 of the proximal tooth cleaning element 152 of the second set of peripheral tooth cleaning elements 150 is located within and extends through the sleeve cavity 165 along the sleeve axis V-V. The bristle tuft portion 159 of the distal tooth cleaning element 153 of the second set of peripheral tooth cleaning elements 150 is located within and extends through the sleeve cavity 166 along the sleeve axis U-U. Bottom ends of each of the bristle tuft portions 155, 157, 159 are melted together to form a portion of the melt matte 106 as discussed above In the exemplified embodiment, for each of the peripheral tooth tooth cleaning elements, 141, 142, 143, 151, 152, 153 of the first and second sets 140, 150, the sleeve cavity 161-166 of the elastomeric sleeve portion 144, 146, 148, 154, 156, 158 has a transverse cross-section comprising a major axis and a minor axis, the major axis being longer than the minor axis. Specifically, the sleeve cavities 161-166 of each of the elastomeric sleeve portions 144, 146, 148, 154, 156, 158 has a major axis extending in the direction of the longitudinal axis B-B of the head 110 and a minor axis extending in a direction transverse to the longitudinal axis B-B of the head 110 such that each of the cavities 161-166 (and each of the) elastomeric sleeve portions 144, 146, 148, 154, 156, 158) extends for a greater distance along the length of the head 110 (in the direction of the longitudinal axis B-B) than along the width of the head 110.

In the exemplified embodiment, the central peripheral tooth cleaning elements 141, 151 of the first and second sets 140, 150 has a first longitudinal length $L_1$, the proximal peripheral tooth cleaning elements 142, 152 of the first and second sets 140, 150 has a second longitudinal length $L_2$, and the distal peripheral tooth cleaning elements 143, 153 of the first and second sets 140, 150 has a third longitudinal length $L_3$. Furthermore, as labeled in FIGS. 9-11, the central peripheral tooth cleaning elements 141, 151 of the first and second sets 140, 150 has a first transverse width $W_1$, the proximal peripheral tooth cleaning elements 142, 152 of the first and second sets 140, 150 has a second transverse width $W_2$, and the distal peripheral tooth cleaning elements 143, 153 of the first and second sets 140, 150 has a third transverse width $W_3$. Although the lengths are only labeled in the figures with regard to the first set of peripheral tooth cleaning elements 140 and the widths are only labeled in the figures with regard to the second set of peripheral tooth cleaning elements 150, it should be understood that the relative lengths and widths provided and discussed herein are equally applicable to the first and second sets of peripheral tooth cleaning elements 140, 150.

In the exemplified embodiment, the first longitudinal length $L_1$ is greater than the first transverse width $W_1$, the second transverse length $L_2$ is greater than the second transverse width $W_2$, and the third transverse width $L_3$ is greater than the third transverse width $W_3$. Furthermore, in the exemplified embodiment the first longitudinal length $L_1$ of the central peripheral tooth cleaning elements 141, 151 of the first and second sets 140, 150 is greater than each of the second and third longitudinal lengths $L_2$, $L_3$ of the proximal and distal tooth cleaning elements 142, 143, 152, 153 of the first and second sets 140, 150. In one embodiment, the second and third longitudinal lengths $L_2$, $L_3$ may be the same, although the invention is not to be so limited and in certain other embodiments the second and third longitudinal lengths $L_2$, $L_3$ may differ from one another. Furthermore, in one embodiment all of the first, second, and third transverse widths $W_1$, $W_2$, $W_3$ may be the same, although the invention is not to be so limited and in other embodiments the first, second, and third transverse widths $W_1$, $W_2$, $W_3$ may be different from one another.

The oral care implement 100 also includes a grouping of proximal cleaning elements 210 and a grouping of distal cleaning elements 220, both of which are generically illustrated as cylinders in dotted-line. Each of the groupings of proximal and distal cleaning elements 210, 220 may comprise one or more cleaning elements, such as bristle tufts, elastomeric elements, or combinations thereof. In certain embodiments, each of the groupings of proximal and distal cleaning elements 210, 220 may comprise arcuate bristle tufts respectively located at the proximal-most and distal-most ends of the head 100. In one such an embodiment, the arcuate proximal-most bristle tuft of the grouping of proximal cleaning elements 210, the arcuate distal-most bristle tuft of the grouping of distal cleaning elements 220, and the first and second sets of peripheral tooth cleaning elements 140, 150, collectively form a loop about the periphery of the front surface 111 of the head 110. This loop surrounds the conical tuft 130 (although there are additional tooth cleaning elements positioned between the conical tuft 130 and each of the tooth cleaning elements that form the loop).

In the exemplified embodiment, the conical tuft 130 is located between the central peripheral tooth cleaning element 141 of the first set 140 and the central peripheral tooth cleaning element 151 of the second set 150. Specifically, the conical tuft 130 is located on the longitudinal axis B-B of the head 110, the central peripheral tooth cleaning element 141 of the first set 140 is located on a first side of the longitudinal axis B-B of the head 110, and the central peripheral tooth cleaning element 151 of the second set 150 is located on a second opposite side of the longitudinal axis B-B of the head 110. Furthermore, the conical tuft 130 is longitudinally aligned with the central peripheral tooth cleaning elements 141, 151 of the first and second sets 140, 150 so that when viewed from the side of the head 110 no portion of the conical tuft 130 is visible (unless the conical tuft 130 has a height that is greater than that of the central peripheral tooth cleaning elements 141, 151). In the exemplified embodiment the first longitudinal length $L_1$ of each of the central peripheral tooth cleaning elements 141, 151 of the first and second sets 140, 150 is greater than the maximum diameter $D_1$ of the transverse cross-sectional area of the cavity 132 of the conical tuft 130. Furthermore, in the exemplified embodiment the first longitudinal length $L_1$ of each of the central peripheral tooth cleaning elements 141, 151 is greater than the outer diameter of the conical tuft 130.

Referring to FIGS. 4-6B and 8-11 concurrently, as noted above in the exemplified embodiment the oral care implement 100 comprises the head plate 121 and the plurality of tooth cleaning elements 115 that are coupled to the head plate 121. Furthermore, the oral care implement 100 also includes an integrally formed elastomeric component 170. The integrally formed elastomeric component 170 is an integral mass of elastomeric material that comprises the sleeve portions 144, 146, 148, 154, 156, 158 of the first and second sets of peripheral tooth cleaning elements 140, 150, a first elastomeric tooth cleaning element 190 and a second elastomeric tooth cleaning element 195. Thus, the sleeve portions 144, 146, 148, 154, 156, 158 of the first and second sets of peripheral tooth cleaning elements 140, 150 and the first and second elastomeric tooth cleaning elements 190, 195 are integrally formed together as a single component that is either coupled to the head plate 121 or directly injection molded onto the head plate 121 (or the head 110 in embodiments in which no head plate 121 is used).

As noted above, the head plate 121 has an upper surface 124 and an opposing lower surface 123. Furthermore, a plurality of through holes 122 are formed into the head plate 121 and extend from the lower surface 123 of the head plate 121 to the upper surface 124 of the head plate 121. Each of the plurality of tooth cleaning elements 115 comprises a cleaning portion 178 that protrudes from the upper surface 124 of the head plate 121 and an anchor portion 179 that is located adjacent to the lower surface 123 of the head plate 121. The anchor portions 179 of the plurality of tooth cleaning elements 115 comprise or form a portion of the melt matte 106.

Figure 4:
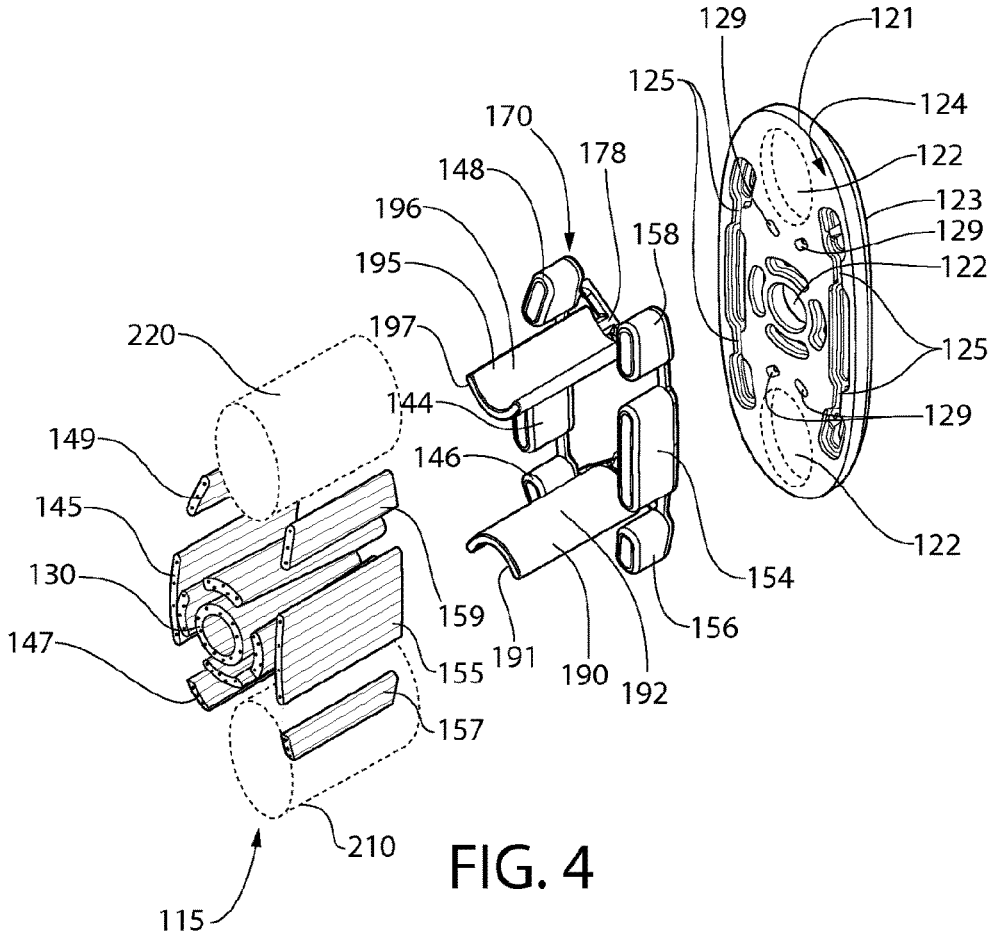
FIG. 4 is an exploded view of a head plate, an integrally formed elastomeric component, and tooth cleaning elements of the oral care implement of FIG. 1.
Figure 6A:
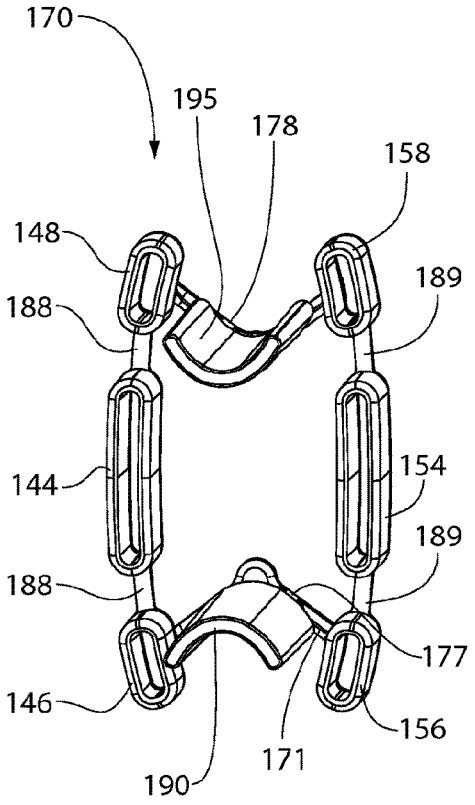
FIG. 6A is a front perspective view of the integrally formed elastomeric component of FIG. 4.
Figure 6B:
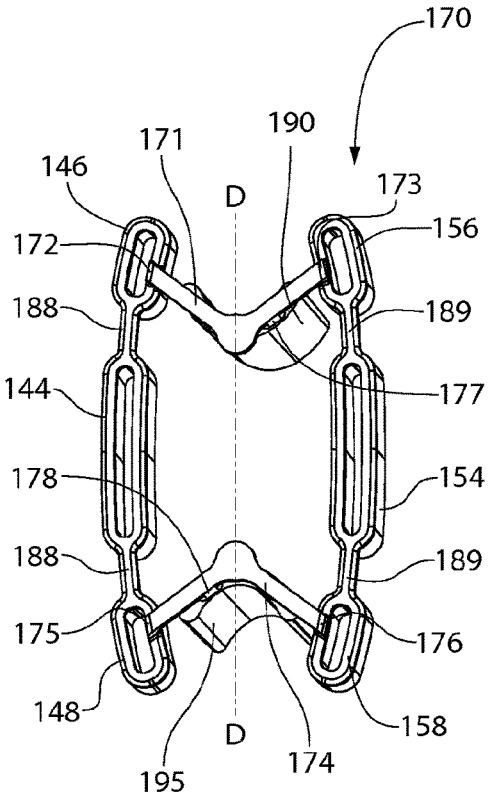
FIG. 6B is a rear perspective view of the integrally formed elastomeric component of FIG. 4.
Figure 7:
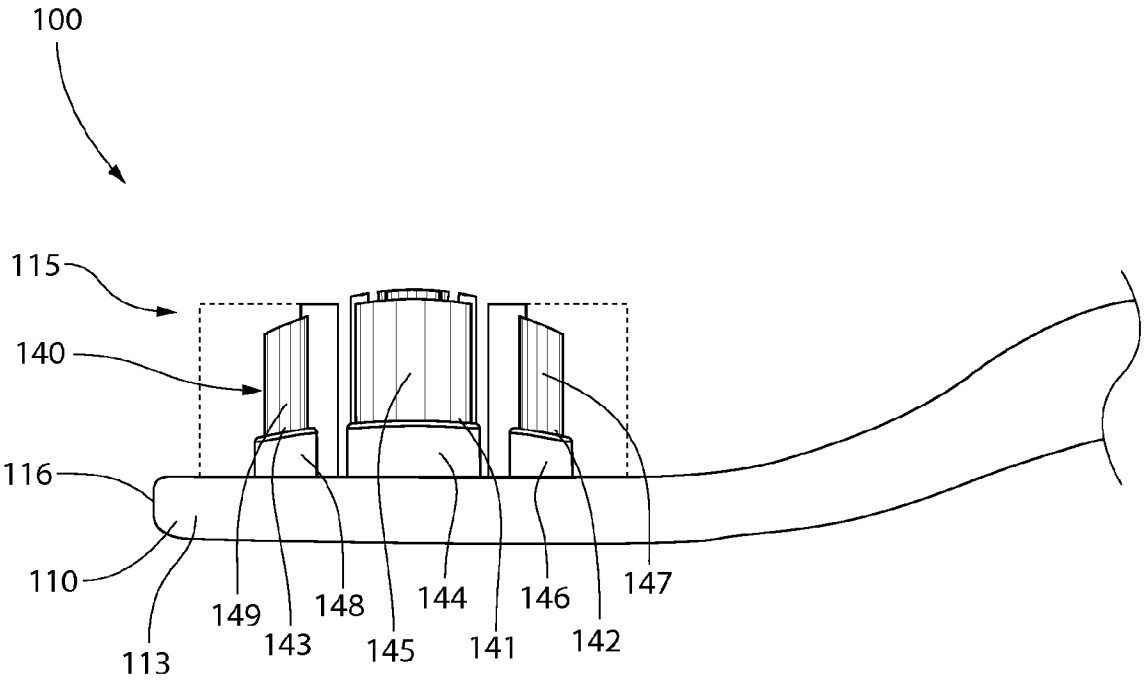
FIG. 7 is a side view of the head of the oral care implement of FIG. 2.
Figure 8:
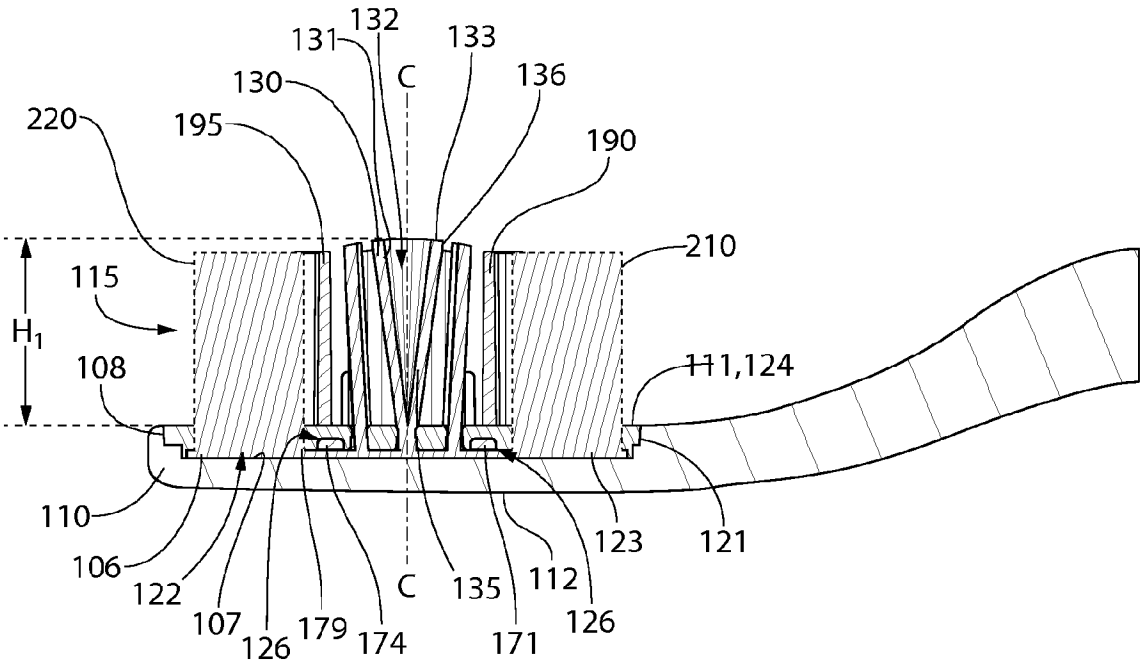
FIG. 8 is a cross-sectional view taken along line VIII-VIII of FIG. 3.

Referring now to FIGS. 4, 6A, and 6B concurrently, the integrally formed elastomeric component 170 will be further described. As noted above, the integrally formed elastomeric component 170 comprises the elastomeric sleeve portions 144, 146, 148, 154, 156, 158 of the first and second sets of peripheral tooth cleaning elements 140, 150 and the first and second elastomeric tooth cleaning elements 190, 195. Furthermore, the integrally formed elastomeric component 170 also comprises a first elastomeric base strip 171 comprising a first end 172 connected to the elastomeric sleeve 146 of the first set of peripheral tooth cleaning elements 140 and a second end 173 connected to the elastomeric sleeve 156 of the second set of peripheral tooth cleaning elements 150. The integrally formed elastomeric component 170 further comprises a second elastomeric base strip 174 comprising a first end 175 connected to the elastomeric sleeve 148 of the first set of peripheral tooth cleaning elements 140 and a second end 176 connected to the elastomeric sleeve 158 of the second set of peripheral tooth cleaning elements 150.

In the exemplified embodiment, each of the first and second elastomeric base strips 171, 174 is V-shaped and has two leg portions that connect at an apex that is located inward of each of the elastomeric sleeves 146, 148, 156, 158 in a direction of the elastomeric sleeves 154, 144. Thus, the apex of the elastomeric base strips 171, 174 are located closer to one another than the first and second ends 172, 173, 175, 176 of the elastomeric base strips 171, 174. More specifically, the integrally formed elastomeric component 170 extends along a longitudinal axis D-D. Each of the first and second elastomeric base strips 171, 174 has two legs that are located on opposing sides of the longitudinal axis D-D and that intersect at the longitudinal axis D-D. Thus, one of the legs of the first elastomeric base strip 171 extends from the longitudinal axis D-D to the elastomeric sleeve portion 146 and the other leg of the first elastomeric base strip 171 extends from the longitudinal axis D-D to the elastomeric sleeve portion 156. Similarly, one of the legs of the second elastomeric base strip 174 extends from the longitudinal axis D-D to the elastomeric sleeve portion 148 and the other leg of the second elastomeric base strip 174 extends from the longitudinal axis D-D to the elastomeric sleeve portion 158.

The first elastomeric tooth cleaning element 190 is arcuate in shape and has a concave surface 191 and a convex surface 192. Furthermore, the first elastomeric tooth cleaning element 190 extends upwardly from the first elastomeric base strip 171 of the integrally formed elastomeric component 170. More specifically, a pair of struts 177 extend upwardly from the first elastomeric base strip 171 to the first elastomeric tooth cleaning element 190. The pair of struts 177 includes a first strut that extends from the first leg of the first elastomeric base strip 171 to a bottom surface of the first elastomeric tooth cleaning element 190 and a second strut that extends from the second leg of the first elastomeric base strip 171 to the bottom surface of the first elastomeric tooth cleaning element 190. Similarly, the second elastomeric tooth cleaning element 195 is arcuate in shape and has a concave surface 196 and a convex surface 197. The second elastomeric tooth cleaning element 195 extends upwardly from the second elastomeric base strip 174 of the integrally formed elastomeric component 170. More specifically, a pair of struts 178 extend upwardly from the second elastomeric base strip 174 to the second elastomeric tooth cleaning element 195. The pair of struts 178 includes a first strut that extends from the first leg of the second elastomeric base strip 174 to a bottom surface of the second elastomeric tooth cleaning element 195 and a second strut that extends from the second leg of the second elastomeric base strip 174 to the bottom surface of the second elastomeric tooth cleaning element 195.

Figure 9:
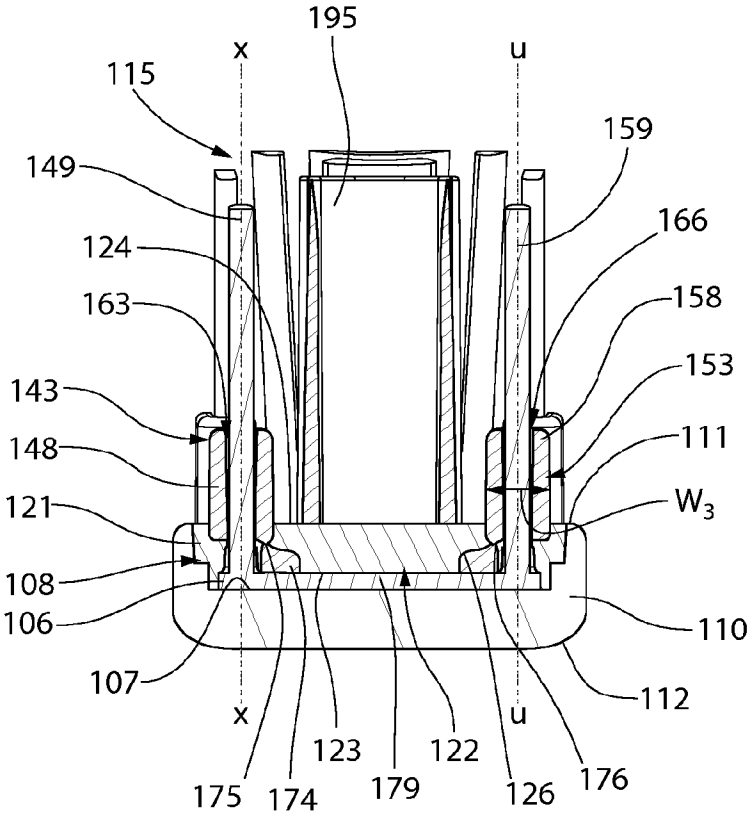
FIG. 9 is a cross-sectional view taken along line IX-IX of FIG. 3.
Figure 11:
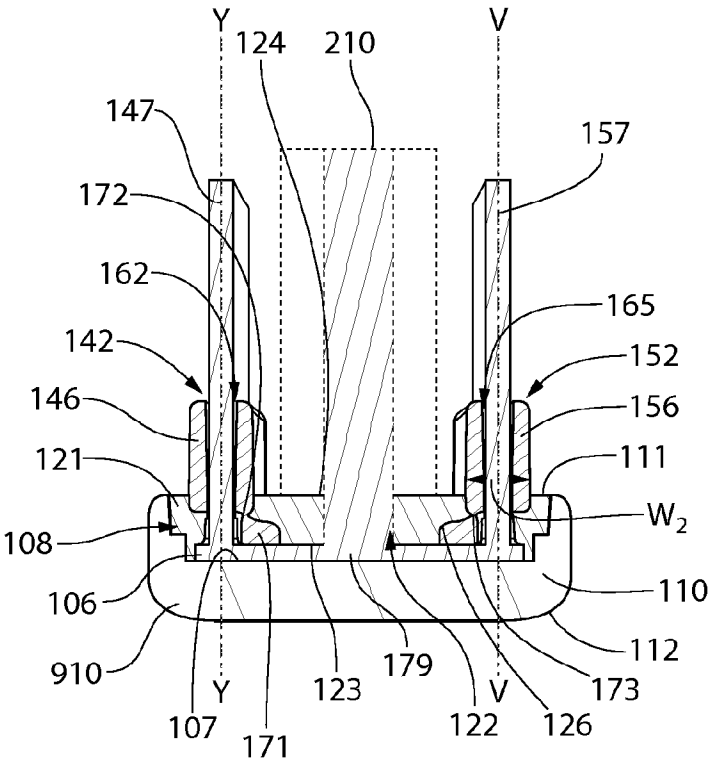
FIG. 11 is a cross-sectional view taken along line XI-XI of FIG. 3.

As will be discussed in more detail below, when the integrally formed elastomeric component is coupled to the head plate 121, the first and second elastomeric base strips 171, 174 are positioned adjacent the lower surface 123 of the head plate 121, the pairs of struts 177, 178 are each located within a through hole 129 of the head plate 121 (see FIG. 5A), and the first and second elastomeric tooth cleaning elements 190, 195 protrude from the upper surface 124 of the head plate 121. As can be seen in FIGS. 9-11, in the exemplified embodiment a lower portion of each of the elastomeric sleeve portions 144, 146, 148, 154, 156, 158 extends into the head plate 121 beyond the upper surface 124 of the head plate 121 so as to be recessed below the front surface 111 of the head 110. Specifically, in one particular embodiment between 10% and 20%, more specifically between 12% and 17%, and still more specifically between 14% and 15% of the height of the elastomeric sleeve portions 144, 146, 148, 154, 156, 158 extends below the front surface 111 of the head 110 with the remainder of the elastomeric sleeve portions 144, 146, 148, 154, 156, 158 protruding from the front surface 111 of the head 110. However, in other embodiments the bottom ends of the elastomeric sleeve portions 144, 146, 148, 154, 156, 158 may rest atop of the upper surface 124 of the head plate 121.

The integrally formed elastomeric component 170 also comprises elastomeric sleeve strips 188 that extend between and connect the elastomeric sleeve portions 144, 146, 148 of adjacent ones of the first set of peripheral tooth cleaning elements 140. Specifically, a first elastomeric sleeve strip 188 extends between and connects the elastomeric sleeve portion 144 to the elastomeric sleeve portion 146. A second elastomeric sleeve strip 188 extends between and connects the elastomeric sleeve portion 144 to the elastomeric sleeve portion 148. Similarly, the integrally formed elastomeric component 170 comprises elastomeric sleeve strips 189 that extend between and connect the elastomeric sleeve portions 154, 156, 158 of adjacent ones of the second set of peripheral tooth cleaning elements 150. Specifically, a first elastomeric sleeve strip 189 extends between and connects the elastomeric sleeve portion 154 to the elastomeric sleeve portion 156. A second elastomeric sleeve strip 189 extends between and connects the elastomeric sleeve portion 154 to the elastomeric sleeve portion 158. When the integrally formed elastomeric component 170 is coupled to the head plate 121, the elastomeric sleeve strips 189 are located on or adjacent to the upper surface 124 of the head plate 121.

The elastomeric base strips 171, 174 and the elastomeric sleeve strips 188, 189 are located at different elevations on the integrally formed elastomeric component 170. Specifically, the elastomeric sleeve strips 188, 189 are flush/planar with a lower surface of the elastomeric sleeve portions 144, 146, 148, 154, 156, 158 and the elastomeric base strips 171, 174 are offset or below the lower surface of the elastomeric sleeve portions 144, 146, 148, 154, 156, 158. This enables the elastomeric sleeve strips 188, 189 to be on the upper surface 124 of the head plate 121 and the elastomeric base strips 171, 174 to be on the lower surface 123 of the head plate 121 when the integrally formed elastomeric component 170 is coupled to the head plate 121, as discussed below.

Figure 5A:
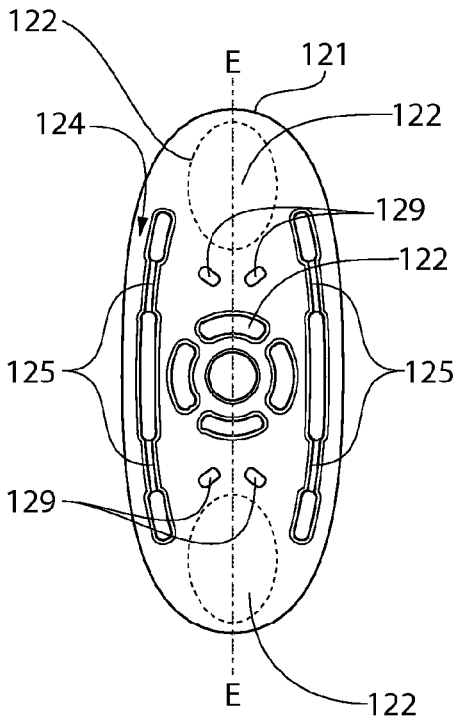
FIG. 5A is a front view of the head plate of FIG. 4.
Figure 5B:
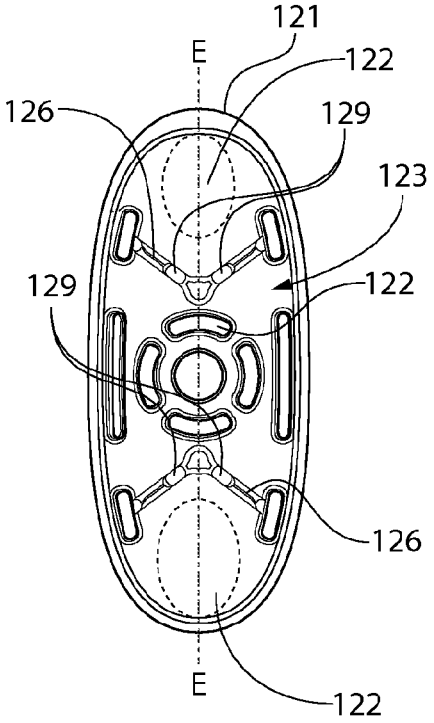
FIG. 5B is a rear view of the head plate of FIG. 4.

Referring to FIGS. 4, 5A, and 5B concurrently, the head plate 121 will be further described. As discussed above, the head plate 121 has an upper surface 124, a lower surface 123, and holes 122, 129 that extend through the head plate 121 from the upper surface 124 to the lower surface 123. Furthermore, the head plate 121 has a longitudinal axis E-E. In addition to the holes 122, the upper surface 124 of the head plate 121 comprises channels 125 that extend between the holes 122 that are located adjacent to the lateral sides of the head plate 121. Specifically, the channels 125 extend between the adjacent holes 122 through which the bristle portions 145, 147, 159, 155, 157, 159 of the first and second sets of peripheral tooth cleaning elements 140, 150 extend. The channels 125 extend along the head plate 121 adjacent to the lateral edges of the head plate 121 in the direction of the longitudinal axis E-E of the head plate 121.

The channels 125 are grooves or recesses formed into the upper surface 124 of the head plate 121 that do not extend all the way through the head plate 121, and thus do not form holes through the head plate 121. Rather, the channels 125 form a grooved or recessed region of the head plate 121 within which the elastomeric sleeve strips 188, 189 are positioned when the integrally formed elastomeric component 170 is coupled to the head plate 121. Specifically, when the integrally formed elastomeric component 170 is coupled to the head plate 121, the elastomeric sleeve strips 188, 189 are located within the channels 125 in the upper surface 124 of the head plate 121. In certain embodiments, the elastomeric sleeve strips 188, 189 are flush with the upper surface 124 of the head plate 121 (because the channels 125 have a depth which is equal to a thickness of the elastomeric sleeve strips 188, 189).

In addition to the channels 125 in the upper surface 124 of the head plate 121, at least one channel 126 is formed in the lower surface 123 of the head plate 121. More specifically, in the exemplified embodiment two of the channels 126 are formed into the lower surface 123 of the head plate 121. One of the channels 126 extends between the tuft hole within which the bristle tuft portion 149 is positioned to the tuft hole within which the bristle tuft portion 159 is positioned. The other one of the channels 126 extends between the tuft hole within which the bristle tuft portion 147 is positioned to the tuft hole within which the bristle tuft portion 157 is positioned. Thus, each of the channels 126 extends transversely across the head plate 121 in a direction transverse to the longitudinal axis E-E of the head plate 121. Furthermore, each of the channels 125 is a V-shaped channel having an apex portion that is positioned closer to the center of the head plate 121 than the terminal ends of the legs which are in spatial communication with the tuft holes within which the bristle tuft portions 147, 149, 157, 159 are positioned.

As can be seen in FIG. 5B, the through holes 129 are located within the channels 126. Thus, when the integrally formed elastomeric component 170 is coupled to the head plate 121, the first and second elastomeric base strips 171, 174 are located within the channels 126 on the rear surface 123 of the head plate 121, the strut portions 177, 178 are located within the through holes 129, and the elastomeric tooth cleaning elements 190, 195 protrude from the upper surface 124 of the head plate 121. In one embodiment, when the integrally formed elastomeric component 170 is coupled to the head plate 121, the first and second elastomeric base strips 171, 174 are flush with the rear surface 123 of the head plate 121.

Thus, the first and second elastomeric tooth cleaning elements 190, 195 protrude from the front surface 111 of the head 110 and are coupled to the head plate 121 via the through holes 129. The through holes 129 which couple the first and second elastomeric tooth cleaning elements 190, 195 to the head plate 121 do not have a similar shape to the shape of the first and second elastomeric tooth cleaning elements 190, 195. Rather, it is only the strut portions 177, 178 that must fit within the through holes 129, and thus in the exemplified embodiment the through holes 129 which affix the first and second elastomeric tooth cleaning elements 190, 195 to the head plate 121 have a cross-sectional area which is less than the cross-sectional area of the elastomeric tooth cleaning elements 190, 195. More specifically, each of the first and second elastomeric tooth cleaning elements 190, 195 is coupled to the head plate 121 via two of the through holes 129. The collective cross-sectional area of the two through holes 129 that affix the first elastomeric tooth cleaning element 190 to the head plate 121 is less than the cross-sectional area of the first elastomeric tooth cleaning element 190. Similarly, the collective cross-sectional area of the two through holes 129 that affix the second elastomeric tooth cleaning element 195 to the head plate 121 is less than the cross-sectional area of the second elastomeric tooth cleaning element 195.

Referring to FIGS. 2, 3, and 8-11 concurrently, the fully assembled head 110 with the head plate 121 and the tooth cleaning elements 115 coupled thereto is illustrated. When viewed from the front surface 111 of the head 110 as depicted in FIGS. 2 and 3, the elastomeric sleeve strips 188, 189 that interconnect the adjacent ones of the elastomeric sleeve portions 144, 146, 148, 154, 156, 158 of the first and second sets of peripheral tooth cleaning elements 140, 150 are visible. This is because the elastomeric sleeve strips 188, 189 are positioned within the channels 125 on the front surface 124 of the head plate 121. Although the first and second elastomeric tooth cleaning elements 190, 195 are formed integrally with the elastomeric sleeve portions 144, 146, 148, 154, 156, 158 of the first and second sets of peripheral tooth cleaning elements 140, 150, the first and second elastomeric base strips 171, 174 that interconnect the elastomeric sleeve portions 144, 146, 148, 154, 156, 158 with the first and second elastomeric tooth cleaning elements 190, 195 are not visible because the first and second elastomeric base strips 171, 174 are positioned within the grooves 126 on the lower surface 123 of the head plate 121, which is completely hidden from view in the assembled oral care implement 100. Thus, the first and second elastomeric tooth cleaning elements 190, 195 appear to be free standing independent elements despite the fact that they are in actuality formed as a part of the integrally formed elastomeric component 170.

The first and second elastomeric tooth cleaning elements 190, 195 are located between the first and second sets of peripheral tooth cleaning elements 130, 140 and on opposite sides of the conical tuft 130. Specifically, the first elastomeric tooth cleaning element 190 is located between the proximal peripheral tooth cleaning element 142 of the first set of peripheral tooth cleaning elements 140 and the proximal peripheral tooth cleaning element 152 of the second set of peripheral tooth cleaning elements. Furthermore, the first elastomeric tooth cleaning element 190 is located between the conical tuft 130 and the proximal end 118 of the head 110. The concave surface 191 of the first elastomeric component 190 faces the proximal end 118 of the head 110 and the convex surface 192 of the first elastomeric component 190 faces the conical tuft 130. The second elastomeric tooth cleaning element 195 is located between the distal peripheral tooth cleaning element 143 of the first set of peripheral tooth cleaning elements 140 and the distal peripheral tooth cleaning element 153 of the second set of peripheral tooth cleaning elements 150. Furthermore, the second elastomeric tooth cleaning element 195 is located between the conical tuft 130 and the distal end 119 of the head 110. The concave surface 196 of the second elastomeric component 195 faces the distal end 119 of the head and the convex surface 197 of the second elastomeric component 195 faces the conical tuft 130.

The pattern of the tooth cleaning elements 115 is such that they have lateral and longitudinal symmetry.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An oral care implement comprising:

a handle;

a head coupled to the handle, the head comprising a front surface, a longitudinal axis extending from a proximal end of the head to a distal end of the head, and a head plate, the head plate comprising a lower surface, an upper surface that forms the front surface of the head, and a plurality of through holes extending from the lower surface to the upper surface;

a plurality of tooth cleaning elements extending from the front surface of the head;

the plurality of tooth cleaning elements comprising a conical tuft comprising a bristle wall having an inner surface defining a cavity along a cavity axis, the cavity having a transverse cross-sectional area that increases with distance from the front surface of the head;

the plurality of tooth cleaning element further comprising:

a first set of peripheral tooth cleaning elements located adjacent to a first lateral edge of the head;

a second set of peripheral tooth cleaning elements located adjacent to a second lateral edge of the head; and each peripheral tooth cleaning element of the first and second sets comprising an elastomeric sleeve portion and a bristle tuft portion extending through a sleeve cavity of the elastomeric sleeve portion along a sleeve axis, the bristle tuft portion protruding from a distal end of the elastomeric sleeve portion;

further comprising an integrally formed mass of elastomeric material, wherein the integrally formed mass of elastomeric material comprises the elastomeric sleeve portions of the first and second sets;

wherein each of the plurality of tooth cleaning elements comprise a cleaning portion protruding from the upper surface of the head plate and an anchor portion located adjacent the lower surface of the head plate; and wherein the integrally formed mass of elastomeric material comprises at least one elastomeric base strip comprising a first end connected to one of the elastomeric sleeve portions of the first set of the peripheral tooth cleaning elements and a second end connected to one of the elastomeric sleeve portions of the second set of the peripheral tooth cleaning elements.

2. The oral care implement according to claim 1 wherein for each of the peripheral tooth cleaning elements of the first and second sets, the sleeve cavity of the elastomeric sleeve portion has a transverse cross-section comprising a major axis and a minor axis, the major axis being longer than the minor axis.

3. The oral care implement according to claim 1 wherein each of the first and second sets of the peripheral tooth cleaning elements comprise a central peripheral tooth cleaning element having a longitudinal length that is greater than a maximum diameter of the transverse cross-sectional area of the cavity of the conical tuft.

4. The oral care implement according to claim 3 wherein the conical tuft is located on the longitudinal axis between the central peripheral tooth cleaning elements of the first and second sets.

5. The oral care implement according to claim 3 wherein each of the first and second sets of the peripheral tooth cleaning elements comprises a proximal peripheral tooth cleaning element and a distal peripheral tooth cleaning element; and wherein for each of the first and second sets, the central peripheral tooth cleaning element is located between the distal and proximal peripheral tooth cleaning elements.

6. The oral care implement according to claim 1 wherein the plurality of tooth cleaning elements further comprises first and second elastomeric tooth cleaning elements located between the first and second sets of peripheral tooth cleaning elements and on opposite sides of the conical tuft; and wherein the integrally formed mass of elastomeric material comprises the first and second elastomeric tooth cleaning elements.

7. The oral care implement according to claim 1 wherein the lower surface of the head plate comprises at least one channel, the at least one elastomeric base strip located within the at least one channel of the lower surface of the head plate.

8. The oral care implement according to claim 7 wherein the integrally formed mass of elastomeric material further comprises elastomeric sleeve strips that extend between and connect the elastomeric sleeve portions of adjacent ones of the peripheral tooth cleaning elements of the first and second sets; wherein the upper surface of the head plate comprises channels; and wherein the elastomeric sleeve strips are located within the channels of the upper surface of the head plate.

9. The oral care implement according to claim 1 wherein the anchor portions of the plurality of tooth cleaning elements comprise a melt matte.

10. An oral care implement comprising:

a handle;

a head coupled to the handle, the head comprising a front surface and a head plate, the head plate comprising a lower surface, an upper surface that forms at least a portion of the front surface of the head, and a plurality of through holes extending from the lower surface to the upper surface;

a plurality of tooth cleaning elements extending from the upper surface of the head plate, the plurality of tooth cleaning elements comprising a cleaning portion protruding from the upper surface of the head plate and an anchor portion located adjacent the lower surface of the head plate;

the plurality of tooth cleaning elements comprising a first set of peripheral tooth cleaning elements located adjacent to a first lateral edge of the head, each of the peripheral tooth cleaning elements of the first set comprising an elastomeric sleeve portion protruding from the upper surface of the head plate, the cleaning portion protruding from the elastomeric sleeve portion.

11. The oral care implement according to claim 10 further comprising:

one or more first channels in the front surface of the head that extend between adjacent ones of the peripheral tooth cleaning elements of the first set;

an integrally formed elastomeric component comprising:

the elastomeric sleeve portions of the first set of the peripheral tooth cleaning elements; and one or more first elastomeric sleeve strips that extend between and connect the elastomeric sleeve portions of adjacent ones of the peripheral tooth cleaning elements of the first set, the one or more first elastomeric sleeve strips located within the one or more first channels;

the plurality of tooth cleaning elements further comprising a second set of the peripheral tooth cleaning elements located adjacent to a second lateral edge of the head;

one or more second channels in the front surface of the head that extend between adjacent ones of the peripheral tooth cleaning elements of the second set; and the integrally formed elastomeric component further comprising one or more second elastomeric sleeve strips that extend between and connect the elastomeric sleeve portions of adjacent ones of the peripheral tooth cleaning elements of the second set, the one or more second elastomeric sleeve strips located within the one or more second channels.

12. The oral care implement according to claim 11 wherein the integrally formed mass of elastomeric material further comprises at least one elastomeric base strip comprising a first end connected to one of the elastomeric sleeve portions of the first set of the peripheral tooth cleaning elements and a second end connected to one of the elastomeric sleeve portions of the second set of the peripheral tooth cleaning elements.

13. The oral care implement according to claim 12 wherein the plurality of tooth cleaning elements further comprises an elastomeric tooth cleaning element; and wherein the integrally formed mass of elastomeric material further comprises the elastomeric tooth cleaning element extending from the at least one elastomeric base strip.

14. The oral care implement according to claim 10 wherein the first set of the peripheral tooth cleaning elements comprises a central peripheral tooth cleaning element, a proximal peripheral tooth cleaning element, and a distal peripheral tooth cleaning element; and wherein the central peripheral tooth cleaning element is located between the distal and proximal peripheral tooth cleaning elements.

15. The oral care implement according to claim 14 wherein the central peripheral tooth cleaning element has a first longitudinal length, the proximal peripheral tooth cleaning element has a second longitudinal length, and the distal peripheral tooth cleaning element has a third longitudinal length, the first longitudinal length being greater than the second and third longitudinal lengths.

16. The oral care implement according to claim 15 wherein the central peripheral tooth cleaning element has a first transverse width that is less than the first longitudinal length, the proximal peripheral tooth cleaning element has a second transverse width that is less than the second longitudinal length, and the distal peripheral tooth cleaning element has a third transverse width that is less than the third longitudinal length.

17. The oral care implement of claim 10 wherein the plurality of tooth cleaning elements comprises a central tuft comprising a plurality of bristles, the anchor portion of a first one of the bristles of the central tuft connected to the anchor portion of a first one of the first set of peripheral tooth cleaning elements via a melt matte.

18. An oral care implement comprising:

a handle;

a head coupled to the handle, the head comprising a front surface and a longitudinal axis extending from a proximal end of the head to a distal end of the head, and a head plate, the head plate comprising a lower surface, an upper surface that forms the front surface of the head, and a plurality of through holes extending from the lower surface to the upper surface;

a plurality of tooth cleaning elements extending from the front surface of the head;

the plurality of tooth cleaning elements comprising a conical tuft comprising a bristle wall having an inner surface defining a cavity along a cavity axis, the cavity having a transverse cross-sectional area that increases with distance from the front surface of the head;

the plurality of tooth cleaning element further comprising:

at least one peripheral tooth cleaning element located adjacent to a first lateral edge of the head;

at least one peripheral tooth cleaning element located adjacent to a second lateral edge of the head; and each peripheral tooth cleaning element comprising an elastomeric sleeve portion and a bristle tuft portion extending through a sleeve cavity of the elastomeric sleeve portion along a sleeve axis, the bristle tuft portion protruding from a distal end of the elastomeric sleeve portion;

wherein each of the plurality of tooth cleaning elements comprise a cleaning portion protruding from the upper surface of the head plate and an anchor portion located adjacent the lower surface of the head plate; and further comprising at least one elastomeric base strip comprising a first end and a second end, the first end connected to one of the elastomeric sleeve portions of the first set of the peripheral tooth cleaning elements and the second end connected to one of the elastomeric sleeve portions of the second set of the peripheral tooth cleaning elements.

19. The oral care implement of claim 18 wherein a transverse plane that is perpendicular to the longitudinal axis of the head and that intersects the front surface of the head intersects the peripheral tooth cleaning element adjacent to the first lateral edge of the head and the peripheral tooth cleaning element adjacent to the second lateral edge of the head.

* * * * *